US005455615A

United States Patent [19]

Burr et al.

[11] Patent Number: 5,455,615

[45] Date of Patent: Oct. 3, 1995

[54] MULTIPLE-ORIFICE DROP-ON-DEMAND INK JET PRINT HEAD HAVING IMPROVED PURGING AND JETTING PERFORMANCE

[75] Inventors: Ronald F. Burr, Wilsonville; Laurent A. Regimbal, Tigard; John S. Moore, Beaverton, all of Oreg.

[73] Assignee: Tektronix, Inc., Wilsonville, Oreg.

[21] Appl. No.: 56,346

[22] Filed: Apr. 30, 1993

Related U.S. Application Data

[63] Continuation-in-part of Ser. No. 894,316, Jun. 4, 1992, abandoned.

[51] Int. Cl.[6] ..... B41J 2/19

[52] U.S. Cl. ..... 347/92; 347/35

[58] Field of Search ..... 346/1.1, 140 R; 347/92, 94, 40, 22, 35, 30

[56] References Cited

U.S. PATENT DOCUMENTS

| | | | |
|---|---|---|---|
| 4,123,761 | 10/1978 | Kimura et al. | 346/140 R |
| 4,216,477 | 8/1980 | Matsuda et al. | 346/140 R |
| 4,367,480 | 1/1983 | Kotoh | 346/140 R |
| 4,387,383 | 6/1983 | Sayko | 346/140 R |
| 4,395,720 | 7/1983 | Grover et al. | 347/94 X |
| 4,521,788 | 6/1985 | Kimura et al. | 346/140 R |
| 4,528,575 | 7/1985 | Matsuda et al. | 346/140 R |
| 4,559,544 | 12/1985 | Matsumoto et al. | 347/40 X |
| 4,580,595 | 7/1987 | Cruz-Uribe et al. | 346/140 R |
| 4,727,378 | 2/1988 | Le et al. | 346/1.1 |
| 4,730,197 | 3/1988 | Raman et al. | 346/140 R |
| 4,809,024 | 2/1989 | DeYoung et al. | 346/140 R |
| 4,883,219 | 11/1989 | Anderson et al. | 228/190 |
| 5,087,930 | 2/1992 | Roy et al. | 346/140 R |

FOREIGN PATENT DOCUMENTS 55-67478 5/1980 Japan .

*Primary Examiner*—Benjamin R. Fuller
*Assistant Examiner*—Alrick Bobb
*Attorney, Agent, or Firm*—Ralph D'Alessandro

[57] ABSTRACT

An improved ink jet print head includes tapered manifolds (222), ports (234), and inlet channels (214) all leading elevationally upward to sweep bubbles from the head, aided by their buoyancy. The ports opening to the inlet channels are distributed at staggered locations throughout the manifolds with at least some of the ports located adjacent to the elevationally highest edge of each manifold. This aspect of the invention reduces bubble entrapment and improves jetting performance by reducing acoustic cross-talk among ink pressure chambers (204) of the head. Moreover, tapering the ink supply manifolds and other features causes more uniform ink flow rates and reduces flow rate stagnation regions within the head. Purging cycles therefore require smaller volumes of ink than with prior designs.

22 Claims, 19 Drawing Sheets

MULTIPLE-ORIFICE DROP-ON-DEMAND INK JET PRINT HEAD HAVING IMPROVED PURGING AND JETTING PERFORMANCE

This is a continuation-in-part of U.S. patent application No. 07/894,316 filed Jun. 4, 1992, now abandoned.

TECHNICAL FIELD

The present invention relates to an improved drop-on-demand ink jet print head and in particular to a compact ink jet print head incorporating multiple arrays of ink jets, each array receiving ink from an ink supply manifold having a tapered cross-sectional area.

BACKGROUND OF THE INVENTION

There have been known apparatus and methods for implementing multiple-orifice drop-on-demand ink jet print heads. In general, each channel of a multiple-orifice drop-on-demand ink jet operates by displacement of ink in an ink pressure chamber and subsequent emission of ink droplets from the ink pressure chamber through a nozzle. Ink is supplied from a common ink supply manifold through an ink inlet to the ink pressure chamber. A driver mechanism is used to displace the ink in the ink pressure chamber. The driver mechanism typically includes a transducer (e.g., a piezoceramic material) bonded to a thin diaphragm. When a voltage is applied to a transducer, the transducer displaces ink in the ink pressure chamber, causing ink flow through the inlet from the ink manifold to the ink pressure chamber and through an outlet and passageway to a nozzle. It is desirable to employ a geometry that permits multiple nozzles to be positioned in a densely packed array. The arrangement of the manifolds, inlets, and chambers and the coupling of the chambers to associated nozzles are not straightforward tasks, especially when compact ink jet array print heads are sought. Incorrect design choices, even in minor features, can cause nonuniform jetting performance.

Uniform jetting performance is generally accomplished by making the various features of each array channel in the ink jet print head substantially identical. Uniform jetting also depends on each channel being clear of air and internally generated gas bubbles which can form in the print head and interfere with jetting performance by blocking ink flow within the head. Therefore, the various features of the multiple-orifice print head must also be designed for effective purging.

An exemplary prior art ink jet print head construction is described in U.S. Pat. No. 4,680,595 of Cruz-Uribe, et al. FIGS. 1 and 4 of Cruz-Uribe et al. show two parallel rows of generally rectangular ink pressure chambers positioned with their centers aligned. The ink jet nozzles are coupled to different respective ink pressure chambers. The central axis of each nozzle extends normal to the plane containing the ink pressure chambers and intersects an extension portion of the ink pressure chamber. An ink manifold of substantially uniform cross-sectional area supplies ink to each of the chambers through a restrictive orifice that is carefully formed to match the nozzle orifice. Restrictive orifices are a form of ink inlet feature that acts to minimize acoustic cross-talk between adjacent channels of the multiple-orifice array. However, such restrictions often trap bubbles and, as a consequence, require frequent purging.

Effective purging depends on a relatively rapid ink flow rate through the various features of the head to sweep away bubbles. Ink flow rate at various locations in the manifold depends on the number of downstream orifice channels being purged and the cross-sectional area of the manifold. The flow rate is, therefore, greater at the upstream end of the manifold than at the downstream end where only a single orifice channel is drawing ink. The ink flow rate at the downstream end of the manifolds may not be sufficient to sweep away bubbles trapped in the manifolds.

U.S. Pat. No. 4,730,197 of Raman et al., which issued on a continuation application of the Cruz-Uribe et al. patent, describes additional embodiments thereof in FIGS. 11A and 11B including the same restrictor and ink manifold features.

U.S. Pat. Nos. 4,216,477 ("Matsuda et al. '477 patent") and 4,528,575 of Matsuda, et al. describe ink jet constructions in which ink is ejected parallel, instead of perpendicular, to the plane of the ink pressure chambers. In general, prior art array ink jet print heads in which the nozzle axes are parallel to the plane of the transducers are of relatively complex design and, therefore, difficult to manufacture. Each orifice channel has a rectangular transducer coupled to an ink chamber that communicates through a passageway to a nozzle orifice. In at least some embodiments described in these patents, the passageways are of different lengths, depending upon the location of the transducer relative to its associated nozzle.

Both patents show ink supply manifolds that have essentially constant cross-sectional areas over their entire lengths. FIG. 1 of the Matsuda et al. '477 patent shows a print head oriented vertically having an ink manifold with an ink supply opening at the bottom. The top of the manifold extends beyond the uppermost inlet to the uppermost orifice channel forming an upper cavity in which bubbles, being less dense than ink, can be entrapped. During purging, little or no ink flows through the upper cavity, effectively preventing the purging of bubbles. Over time, additional entrapped bubbles can coalesce into a single large bubble that effectively blocks ink flow to an upper orifice channel. Moreover, entrapped bubbles have a resonant frequency and cause pressure pulses generated in a pressure chamber to be non-uniformly reflected back to inlets of adjacent pressure chambers. Entrapped bubbles also dissipate energy at certain frequencies. Therefore, entrapped bubbles contribute to non-uniform jetting.

U.S. Pat. No. 4,387,383 of Sayko describes a multiple-orifice ink jet head. In FIG. 2, Sayko illustrates an ink manifold having a uniform cross-sectional area and in which the ink supply inlet is positioned at the top. Such a design minimizes entrapment of bubbles and facilitates their purgability, but exacerbates the entrapment of contaminants that are more dense than the ink. The lack of sufficient ink flow rate at the bottom end of such a manifold prevents contaminants from being swept away during purging and leads to clogging of features in the lowermost orifice channels.

U.S. Pat. No. 4,521,788 of Kimura et al. describes a multiple-orifice ink jet print head of radial construction with channel-to-channel feature uniformity that leads to uniform jetting performance. The radial ink supply manifolds of Kimura et al. illustrated in FIGS. 3, 6, and 7 are all of uniform cross-sectional area and include previously described features that can entrap contaminants or bubbles.

U.S. Pat. No. 4,367,480 of Kotoh describes a multiple-orifice ink jet print head having uniform feature sizes in each orifice channel. FIG. 4 of Kotoh illustrates an ink manifold having a nonuniform cross-sectional area. However, the shape illustrated can entrap contaminants or bubbles. FIGS. 8 and 10 of Kotoh illustrate a nonuniform serpentine ink inlet configuration that provides uniform acoustic performance among orifice channels. Also shown is an ink supply manifold with ink inlets at both ends. Such a configuration allows cross-flow purging (rapid ink flow in one ink inlet, through the manifold, and out the other inlet) that is effective at removing contaminants or bubbles from such an ink manifold, but not from the various features of each orifice channel. In addition, some compact head constructions do not have sufficient space for the additional manifold inlets required by cross-flow purging.

U.S. Pat. No. 5,087,930 of Roy et al. for DROP-ON-DEMAND INK JET PRINT HEAD, which is assigned to the assignee of the present application, describes a multiple-orifice print head of compact design. Pertinent components of the Roy et al. patent are diagrammed in FIGS. 1A, 1B, 2, 3, and 4 of the present application. FIGS. 1A and 1B are exploded views of the laminated plate construction of a print head 1 that includes a transducer receiving plate 2, a diaphragm plate 3, an ink pressure chamber plate 31, a separator plate 4, an ink inlet plate 5, a separator plate 6, an offset channel plate 7, an orifice separator plate 8, and an orifice plate 9. Plates 3 through 7 also form a set of black, yellow, magenta, and cyan ink manifolds. FIGS. 2-4 show each of the respective plates 5 through 7 in greater detail. In particular, a lower magenta ink manifold M is connected to the upper magenta ink manifold M' by an ink communication channel C. Ink is drawn as required from manifolds M and M' into multiple ink supply channels S, one for each magenta orifice channel of print head 1.

Referring now to FIGS. 3 and 4, it has been discovered that, during periods of no printing, a buoyant bubble B can become entrapped in an upper arch of ink communication channel C. During periods of printing, ink flows through channel C and manifold M' at a rate sufficient to drag bubble B to the inlet end of manifold M'. However, the rate of flow is insufficient to cause bubble B to be swept away through any of the ink supply channels S of print head 1. During purging, ink is caused to flow at an increased rate through manifolds M and M' and through ink supply channels S, causing bubble B to be drawn to a location B' at the right-hand end of manifold M'. However, bubble B' is not swept out of the rightmost end of manifold M' because only a single ink supply channel S' draws ink, resulting in a low ink flow rate. The buoyant force of bubble B' being greater than the ink flow rate-induced drag force on bubble B', causes bubble B' to remain entrapped. Moreover, entrapped bubble B' has a resonant frequency that acts to increase pressure pulse cross-talk among supply channels S within manifold M' whenever an ink orifice channel ejects ink drops at a rate near the resonant frequency of bubble B'. At some ejection rates, energy will be transferred to the bubble, causing it to grow, which can lead to starvation of print head 1.

To make matters worse, during normal printing the position of bubble B' in manifold M' depends on the droplet ejection patterns and rates for the multiple ink supply channels S coupled to manifold M'. The resulting cross-talk and bubble interaction induced jetting non-uniformities are visible in printed images as magenta intensity variations. Similar problems exist because of bubbles in the other manifolds of print head 1.

Although there are many prior art multiple-orifice ink jet print head designs, a need exists for an improved ink jet print head that is compact, has uniform jetting characteristics, and is capable of being completely purged of air or other gas bubbles.

SUMMARY OF THE INVENTION

An object of this invention is, therefore, to provide a multiple-orifice ink jet head that is capable of being completely purged of air or other gas bubbles.

Another object of the present invention is to provide an ink jet print head having individual jets that have substantially constant and identical ink drop jetting characteristics.

Yet another object of this invention is to provide a compact print head design having reduced acoustic cross-talk among orifice channels.

A further object of this invention is provide a print head design that uses the buoyancy of entrapped air or other gas bubbles to assist in purging the head, the purging requiring a minimum volume of ink, a minimum ink purge flow rate, and a minimum purge vacuum or pressure to completely purge the head.

The present invention is a drop-on-demand ink jet print head that provides ink from a common ink supply manifold, through multiple inlets, and into a corresponding number of ink pressure chambers, each of which is coupled to an acoustic transducer that causes controlled pressure waves in the ink. The pressure waves cause ink to flow through an ink outlet, into an offset channel, and through an orifice as droplets of ink ejected toward a print medium. The ink jet print head has a body that defines an ink supply manifold, ink inlets, ink pressure chambers, outlets, offset channels, and nozzle orifices. The ink jet print head is of a compact design having closely spaced nozzles.

To provide more uniform ink jetting characteristics, the ink jet head passages from the ink supply manifold to the ink pressure chambers and from the ink pressure chambers to the nozzles are each preferably of the same length and cross-sectional area so that the ink jetting characteristics of the ink pressure chambers, associated passages, and nozzles are substantially the same.

The ink jet print head has at least one tapered ink supply manifold and .multiple ink supply channels that couple the tapered ink supply manifold to respective ink pressure chamber ink inlets. The ink supply channels are sized and the manifold is tapered to provide acoustic isolation between the ink pressure chambers and the manifold, while still providing a sufficient ink flow at the highest print rates of the ink jet print head. Tapering the manifold provides a reduced cross-sectional area toward the downstream end of the manifold, resulting in more uniform ink flow rate along the entire length of the manifold during printing and purging.

The ink jet print head is preferably formed of multiple flat plates that are held together to define the various chambers, passages, channels, nozzles, and manifolds of the ink jet print head.

In a preferred embodiment of the ink jet print head, the ink inlets, tapered manifolds, and inlet channels all lead vertically upwardly to naturally sweep bubbles out of the head, aided by their natural buoyancy. Ports opening to the inlet channels are distributed at staggered locations throughout the manifolds with at least some of the ports located adjacent to the elevationally highest edge of each manifold. This aspect of the invention reduces bubble entrapment and acoustic cross-talk among the ink pressure chambers of the head. Moreover, tapering the manifolds and other features of the head tends to sweep small bubbles away before they can coalesce and grow to a diameter that disrupts operation of the head. Purging such an ink jet head requires a smaller volume of ink at a lower ink purge flow rate than with prior designs.

BRIEF DESCRIPTION OF THE DRAWINGS

These and other objects, features and advantages of the invention will become apparent upon consideration of the following detailed disclosure of the invention, especially when it is taken in conjunction with the accompanying drawings wherein.

DETAILED DESCRIPTION OF PREFERRED EMBODIMENT

Figure 1A:
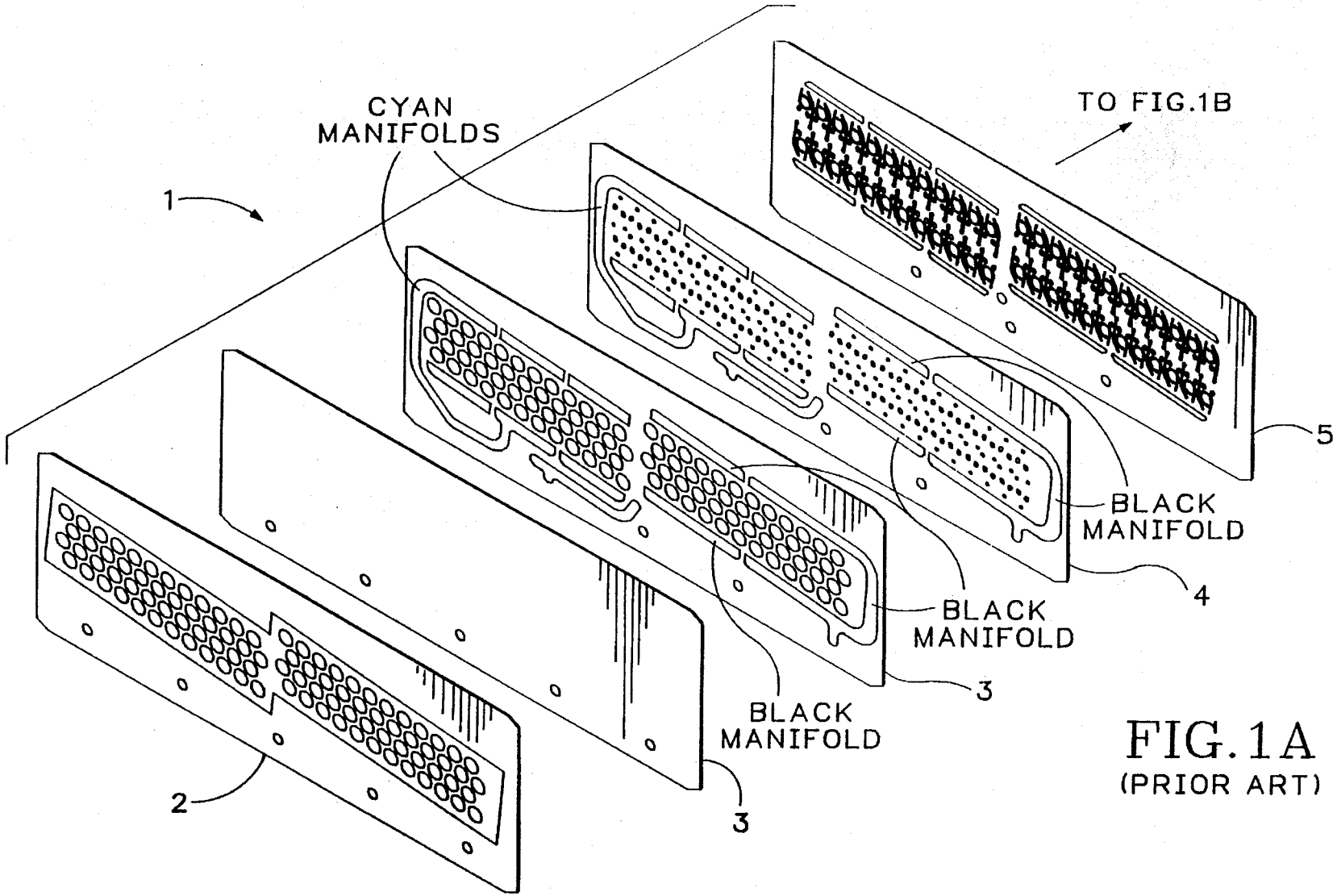
FIG. 1A (PRIOR ART)
FIGS. 1A and 1B together form an exploded isometric view of the various layers of a prior art array-type ink jet print head having two arrays of 48 nozzles each.
Figure 1B:
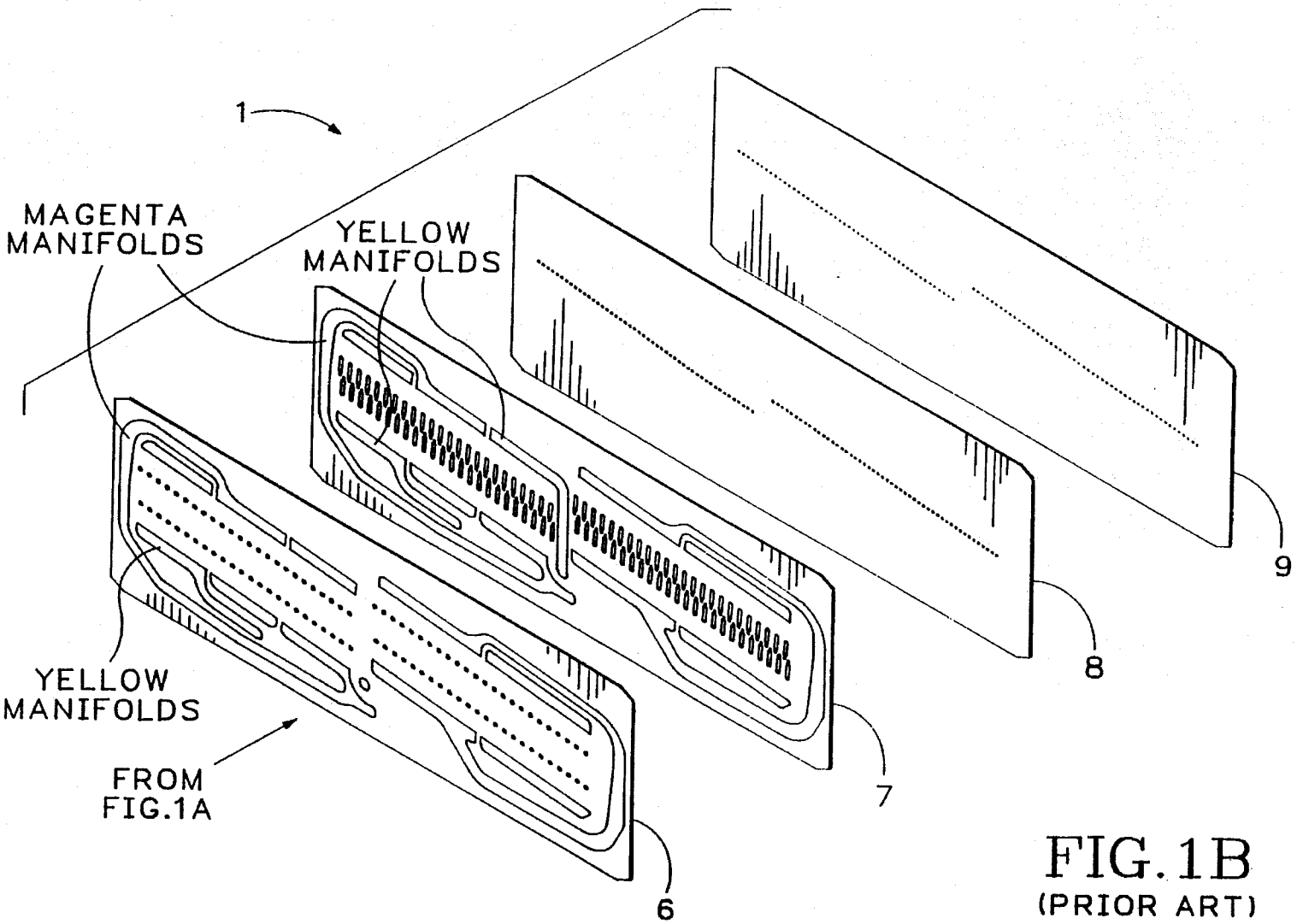
FIG. 1B (PRIOR ART)
Figure 2:
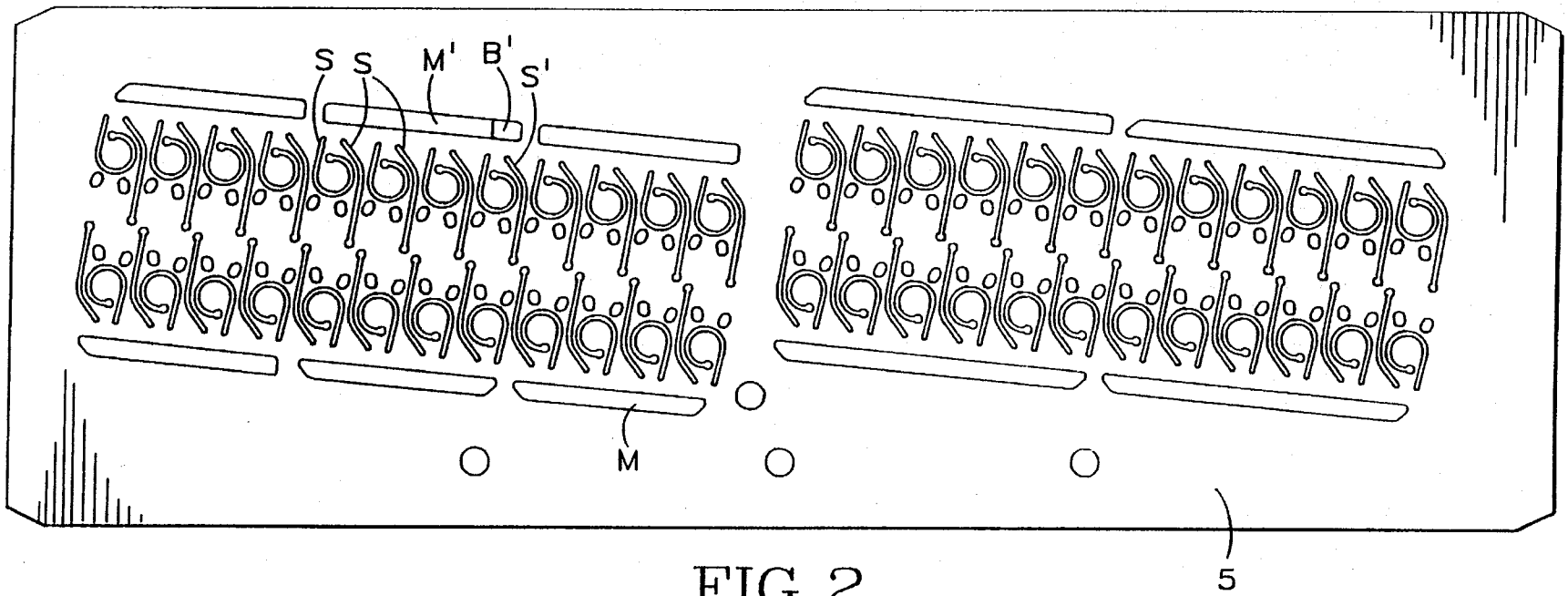
FIG. 2 (PRIOR ART)
FIGS. 2–4 are enlarged frontal views of representative plates forming the ink manifolds and ink inlet channels of the prior art ink jet head illustrated in FIGS. 1A and 1B, with portions of the manifolds shown in FIGS. 3 and 4 shown as broken lines in FIG. 2.
Figure 3:
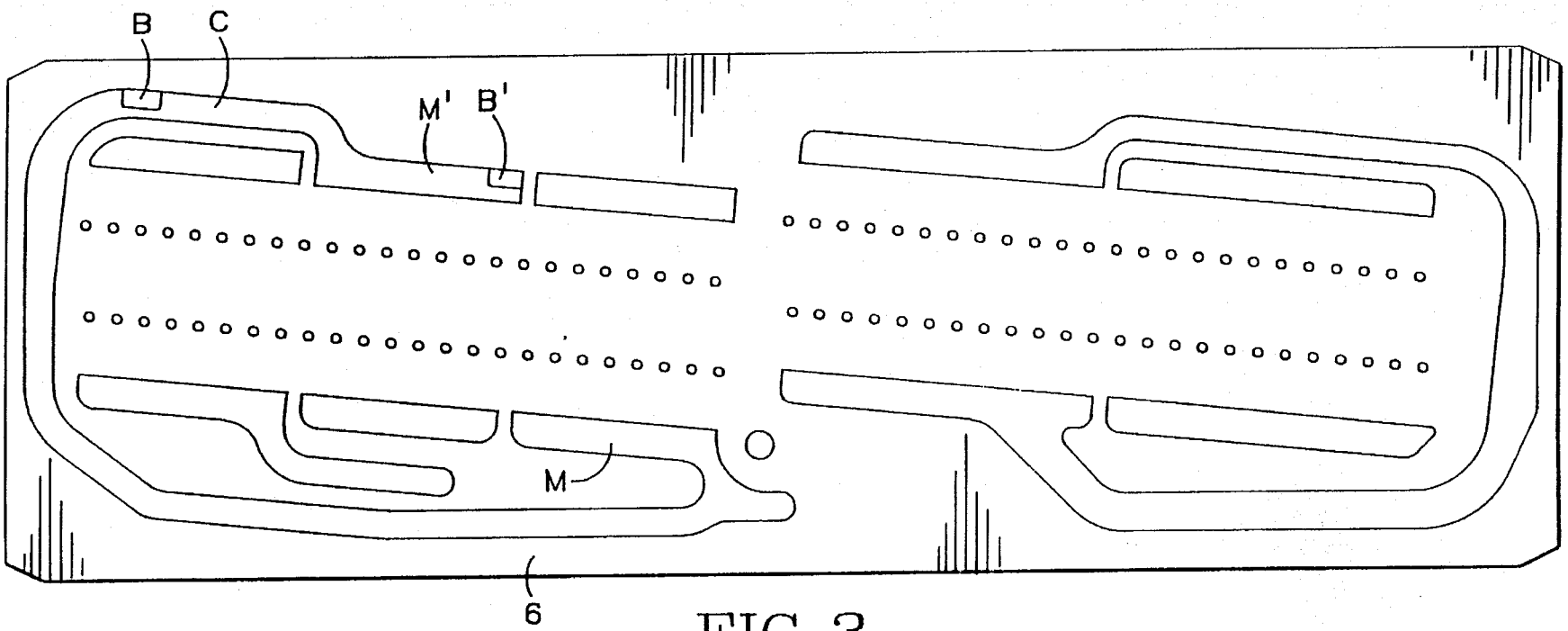
FIG. 3 (PRIOR ART)
Figure 4:
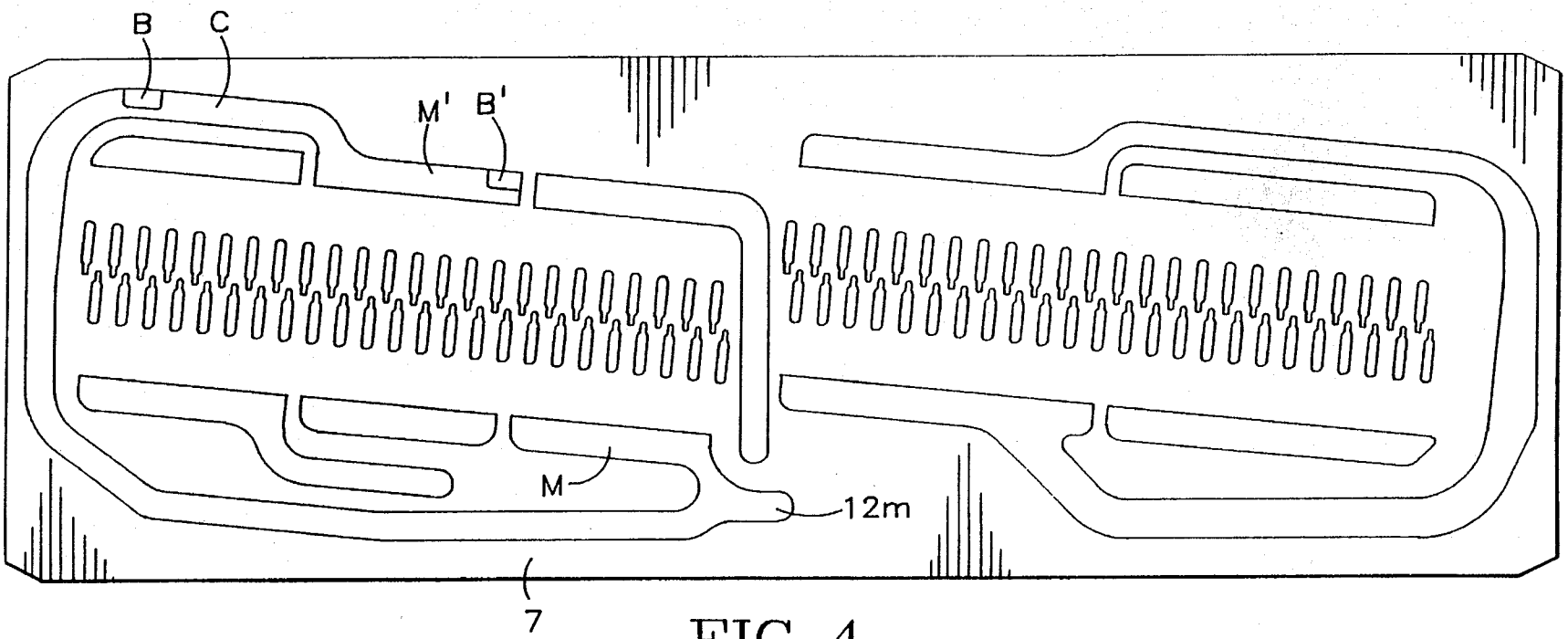
FIG. 4 (PRIOR ART)

U.S. patent application No. 07/894,316 for A DROP-ON-DEMAND INK JET PRINT HEAD HAVING IMPROVED PURGING PERFORMANCE, filed Jun. 4, 1992, and assigned to the assignee of this application is hereby specifically incorporated by reference in pertinent part.

The print head of the present invention incorporates a compact array of ink drop-forming nozzles, each selectively driven by an associated driver, such as by a piezoceramic transducer mechanism. The design considerations for such a print head are explained with reference to the following example. An ink jet print head used in a typewriter-like print engine vertically advances a print medium on a curved surface past a spaced-apart print head that shuttles back and forth and prints in both directions during shuttling. It is desirable to provide such a print head with an array of nozzles that span the minimum possible vertical distance so as to minimize the variation in distance between them and the print medium.

It is also desirable to provide a print head that spans the minimum horizontal distance. The portion of a print head that prints with 48 jets at 118 lines/centimeter (300 lines/inch) both horizontally and vertically, for example, would have a vertical row of 48 nozzles that span 47/118 centimeter (47/300 inch) from the centers of the first and last nozzles. In this configuration, each nozzle could address the left-most, as well as the right-most, address location on the print medium without overscan. Any horizontal displacement of the nozzles requires overscan at both the left and right margins by at least the amount of this displacement so that all of the print medium locations can be addressed. Overscanning increases both the print time and the overall width of the printer. Minimizing the horizontal spacing between nozzles helps reduce the print time and the printer width. Because the transverse dimensions of the pressure transducers required for jets of the type described here are many times larger than the vertical nozzle-to-nozzle spacing, a certain amount of horizontal displacement of the nozzles is necessary, the amount being dictated by the size of the transducers and their geometric arrangement. An objective is to minimize this displacement.

One approach for minimizing the horizontal spacing of nozzles is to allow no features within the boundaries of the array of ink pressure chambers or pressure transducers. All other features would be either outside the boundary of the array of these transducers or pressure chambers if they are in the plane of these components or placed in planes above (farther from the nozzles) or below (closer to the nozzles) these components. For example, all electrical connections to the transducers can be made in a plane above the pressure transducers and all inlet passages, offset channel passages, outlet passages, and nozzles can be in planes below the ink pressure chambers and pressure transducers. Whenever two of these types of features would interfere with each other geometrically if they were placed in the same plane, they are placed in different planes from each other so that the horizontal displacement of the nozzles is controlled only by how closely the pressure transducers or pressure chambers can be positioned. For example, the inlet passages can be in a different plane from that of the offset channel passages and the offset channel passages can be in a different plane from that of the outlet passages. Thus, to minimize the horizontal and vertical dimensions of the array of nozzles, extra layers are added, resulting in an increase of the thickness of the print head.

Integrated electronic driver circuits are generally less expensive than those made from individual components and are even less expensive if all of the integrated circuit drivers are triggered simultaneously. Thus, if the nozzles of the print head cannot be arranged in a vertical line, then the horizontal displacement between one nozzle and any other should be some integer multiple of the vertical nozzle-to-nozzle spacing if inexpensive driver circuits are to be used. If more than one driver circuit is to be used, then this requirement is relaxed, but all of the nozzles driven by a single integrated circuit should still be spaced apart in the horizontal direction by integer multiples of the vertical nozzle-to-nozzle spacing. It is also desirable to have a compact print head that has low drive voltage requirements, is capable of operating at a high ink drop election rate, is relatively inexpensive to fabricate, and can print multiple colors of ink.

Figure 5:
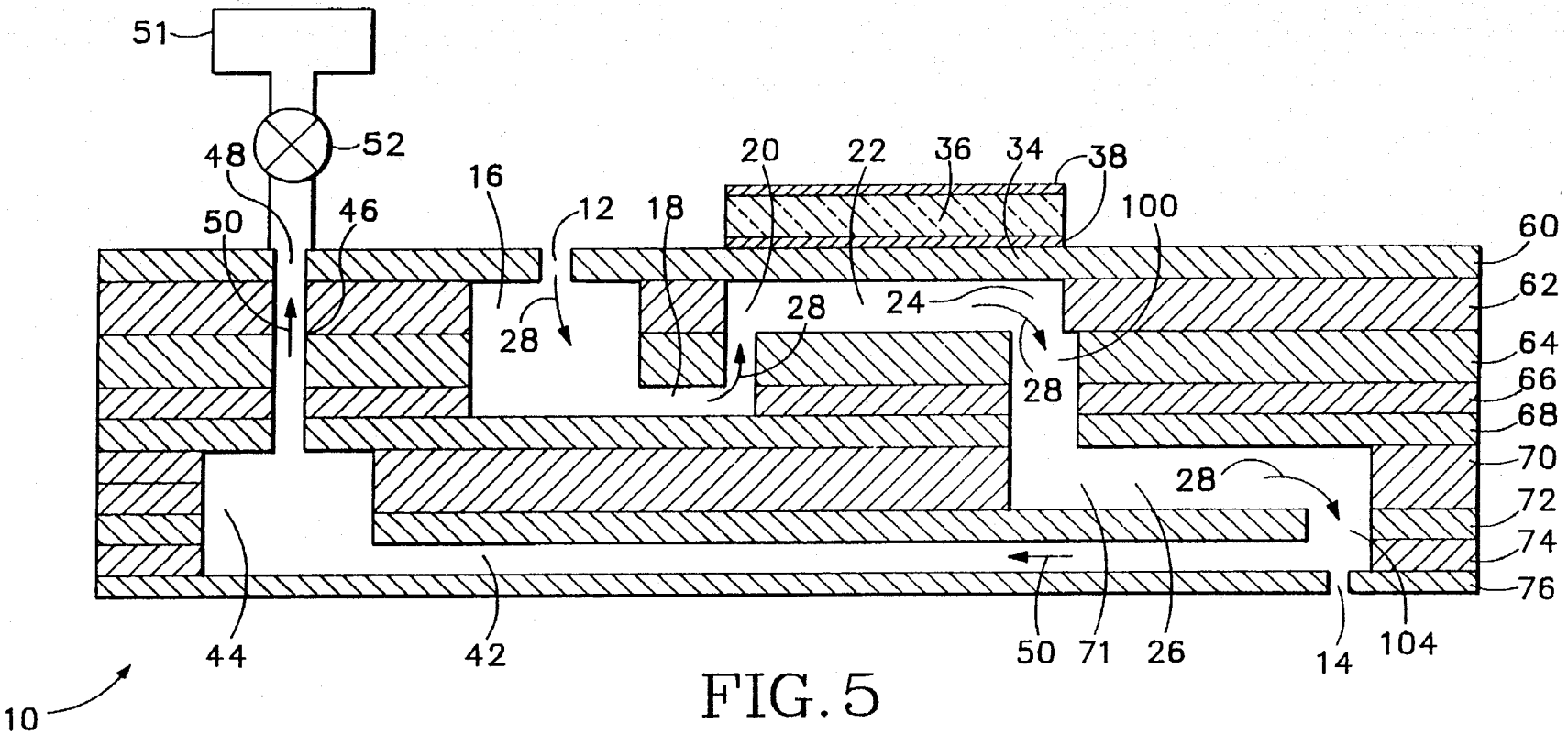
FIG. 5 is a diagrammatic cross-sectional view of a single ink jet of the type included in an array jet print head of the present invention.

Referring to FIG. 5, a cross-sectional view of one orifice channel of a multiple-orifice ink jet print head according to the invention is shown having a body 10 which defines an ink inlet 12 through which ink is delivered to the ink jet print head. The body also defines an ink drop forming orifice outlet or nozzle 14 together with an ink flow path from the ink inlet 12 to the nozzle. In general, the ink jet print head of the present invention preferably includes an array of nozzles 14 which are closely spaced from one another for use in printing drops of ink onto a print medium (not shown).

Ink entering ink inlet 12 flows into a tapered ink supply manifold 16 (tapering not shown in FIG. 5). A typical ink jet print head has at least four such manifolds for receiving, black, cyan, magenta, and yellow ink for use in black plus subtractive three-color printing. However, the number of such manifolds may be varied depending upon whether a printer is designed to print solely in black ink or with less than a full range of color. Ink flows from tapered ink supply manifold 16, through an ink supply channel 18, through an ink inlet 20, and into an ink pressure chamber 22. Ink leaves the pressure chamber 22 by way of an ink pressure chamber outlet 24 and flows through an ink passage 26 to nozzle 14, from which ink drops are ejected. Arrows 28 diagram the just-described ink flow path.

Ink pressure chamber 22 is bounded on one side by a flexible diaphragm 34. The pressure transducer in this case is a piezoelectric ceramic disc 36 secured to diaphragm 34 by epoxy and overlays ink pressure chamber 22. In a conventional manner, ceramic disc transducer 36 has metal film layers 38 to which an electronic circuit driver, not shown, is electrically connected. Although other forms of pressure transducers may be used, ceramic disc transducer 36 is operated in its bending mode such that when a voltage is applied across metal film layers 38, ceramic disc transducer 36 attempts to change its dimensions. However, because it is securely and rigidly attached to the diaphragm, ceramic disc transducer 36 bends and thereby displaces ink in ink pressure chamber 22, causing the outward flow of ink through passage 26 to nozzle 14. Refill of ink chamber 22 following the ejection of an ink drop is augmented by reverse bending of ceramic disc transducer 36.

In addition to the main ink flow path 28 described above, an optional ink purging channel 42 is defined by the ink chamber body 10. Purging channel 42 is coupled to ink passage 26 at a location adjacent to, but interiorly of nozzle 14. Purging channel 42 communicates from ink passage 26 to a purging manifold 44 that is connected by an outlet passage 46 to a purging outlet port 48. Purging manifold 44 is typically connected by similar purging channels 42 to the passages associated with multiple nozzles. During a purging operation, ink flows through body 10 in a direction indicated by arrows 28 and 50. The direction and rate of ink flow through nozzle 14 during purging depends on relative pressure levels at ink inlet 12, nozzle 14, and purging outlet port 48. Purging is described in more detail below.

To facilitate manufacture of the ink jet print head of the present invention, body 10 is preferably formed of multiple laminated plates or sheets, such as of stainless steel. These sheets are stacked in a superimposed relationship. In the illustrated FIG. 5 embodiment of the present invention, these sheets or plates include a diaphragm plate 60, which forms diaphragm 34, ink inlet 12, and purging outlet 48; an ink pressure chamber plate 62, which defines ink pressure chamber 22, a portion of ink supply manifold 16, and a portion of purging passage 48; a separator plate 64, which defines a portion of ink passage 26, bounds one side of ink pressure chamber 22, defines inlet 20 and outlet 24 to ink pressure chamber 22, defines a portion of ink supply manifold 16, and defines a portion of purging passage 46; an ink inlet plate 66, which defines a portion of passage 26, inlet channel 18, and a portion of purging passage 46; another separator plate 68, which defines portions of passages 26 and 46; an offset channel plate 70, which defines a major or offset portion 71 of passage 26 and a portion of purging manifold 44; a separator plate 72, which defines portions of passage 26 and purging manifold 44; an outlet plate 74, which defines purging channel 42 and a portion of purging manifold 44; and a nozzle plate 76, which defines nozzles 14 of the array.

More or fewer plates than those illustrated may be used to define the various ink flow passageways, manifolds, and pressure chambers of the ink jet print head of the present invention. For example, multiple plates may be used to define an ink pressure chamber instead of the single plate illustrated in FIG. 5. Also, not all of the various features need be in separate sheets or layers of metal. For example, patterns in the photo-resist that are used as templates for chemically etching the metal (if chemical etching is used in manufacturing) could be different on each side of a metal sheet. Thus, as a more specific example, the pattern for the ink inlet passage could be placed on one side of the metal sheet while the pattern for the pressure chamber could be placed on the other side and in registration front-to-back. Thus, with carefully controlled etching, separate ink inlet passage and pressure chamber containing layers could be combined into one common layer.

To minimize fabrication costs, all of the metal layers of the ink jet print head, except nozzle plate 76, are designed so that they may be fabricated using relatively inexpensive conventional photo-patterning and etching processes in metal sheet stock. Machining or other metal working processes are not required. Nozzle plate 76 has been made successfully using any number of various processes, including electroforming from a sulfumate nickel bath, microelectric discharge machining in three hundred series stainless steel, and punching three hundred series stainless steel, the last two approaches being used in concert with photo-patterning and etching all of the features of the nozzle plate except the nozzles themselves. Another suitable approach is to punch the nozzles and to use a standard blanking process to form the rest of the features in this plate.

The print head of the present invention is designed so that layer-to-layer alignment is not critical in that tolerances typically held in a chemical etching process are adequate. The various layers forming the ink jet print head of the present invention may be aligned and bonded in any suitable manner, including the use of suitable mechanical fasteners. However, a preferred approach for bonding the metal layers is described in U.S. Pat. No. 4,883,219 of Anderson, et al. for MANUFACTURE OF INK JET PRINT HEADS BY DIFFUSION BONDING AND BRAZING, which is assigned to the assignee of the present application. This bonding process is hermetic, produces high-strength bonds between the parts, leaves no visible fillets to plug the small channels in the print head, does not distort the features of the print head, and yields an extremely high percentage (almost 100%) of satisfactory print heads. This manufacturing process can be implemented with standard plating equipment, standard furnaces, and simple diffusion bonding fixtures and can take fewer than three hours from start to finish for the complete bonding cycle, while many ink jet print heads are simultaneously manufactured. In addition, the plated metal is so thin that essentially all of it diffuses into the stainless steel during the brazing step so that none of it is left to interact with the ink, either to be attacked chemically or by electrolysis. Therefore, plating materials, such as copper, that are readily attacked by some inks may be used in this bonding process.

The electromechanical transducer mechanism selected for the ink jet print heads of the present invention can comprise ceramic disc transducers 36 bonded with epoxy to the metal diaphragm plate 60, with each of the discs centered over a respective ink pressure chamber 22. For this type of transducer mechanism, a substantially circular shape has the highest electromechanical efficiency, which refers to the volume displacement for a given area of the piezoceramic element. Thus, transducers of this type are more efficient than rectangular type, bending mode transducers.

To provide an extremely compact and easily manufacturable ink jet print head, the various pressure chambers 22 are generally planar in that they are much larger in transverse cross-sectional dimension than in depth. This configuration results in a higher pressure for a given displacement of the transducer into the volume of pressure chambers 22. Moreover, all of ink jet pressure chambers 22 of the ink jet print head of the present invention are preferably, although not necessarily, located in the same plane or at the same depth within the ink jet print head. This plane is defined by the plane of one or more plates 62 used to define these pressure chambers.

Figure 6:
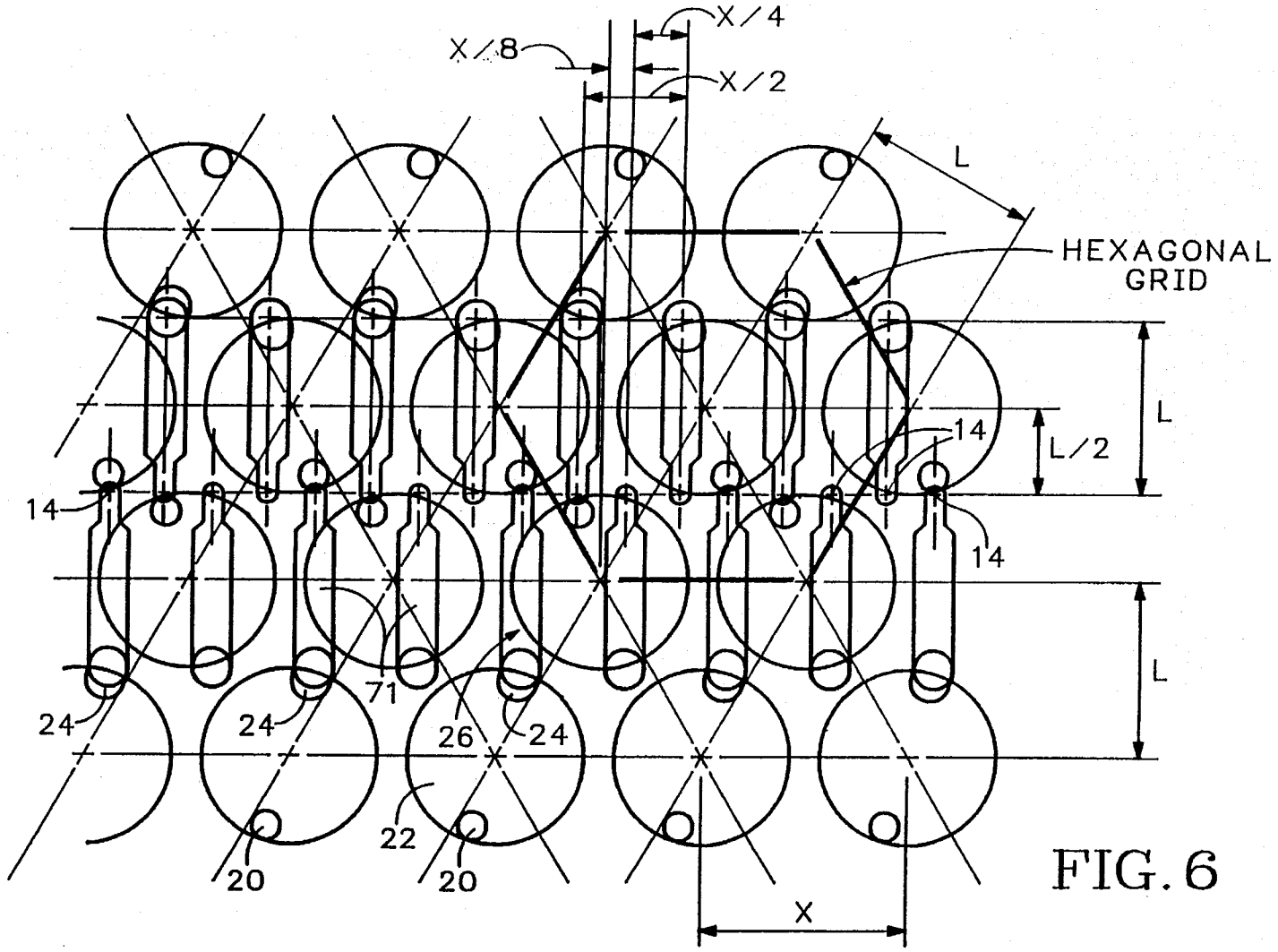
FIG. 6 is an enlarged schematic overlay view showing the transverse spacings and orientations of ink pressure chambers, ink inlet and outlet ports, and of an ink jet head according to this invention.

In order to achieve an extremely high packing density, ink pressure chambers 22 are arranged in parallel rows with their geometric centers offset or staggered from one another. Also, pressure chambers 22 are typically separated by very little sheet material. In general, only enough sheet material remains between the pressure chambers as is required to accomplish reliable (leak-free) bonding of the ink pressure defining layers to adjacent layers. As shown in FIG. 6, one embodiment comprises four parallel rows of pressure chambers 22 whose centers are spaced apart by a distance L with the centers of the chambers of one row offset from the centers of the chambers of an adjacent row. In particular, with circular pressure chambers, the four parallel rows of pressure chambers are offset so that their geometric centers, if interconnected by the bold lines shown in FIG. 6, would lie on a hexagonal grid. The centers of pressure chambers 22 may be located in a grid or array of irregular hexagons, but the most compact configuration is achieved with a grid of regular hexagons. This grid may be extended indefinitely in any direction to increase the number of ink pressure chambers and nozzles in a particular ink jet print head.

In general, for reasons of efficient operation, it is preferable that pressure chambers 22 have a transverse cross-sectional dimension that is substantially equal in all directions. Hence, pressure chambers having substantially circular cross-sections have been found to be the most efficient. However, other configurations such as pressure chambers having a substantially hexagonal cross-section, and thus having substantially equal transverse cross-sectional dimensions in all directions, would also be efficient. Pressure chambers having other cross-sectional dimensions may also be used, but those with substantially the same uniform transverse cross-sectional dimension in all directions are preferred.

Piezoceramic discs 36 are typically no more than 0.254 millimeter (0.010 inch) thick, but they may be either thicker or thinner. While ideally these disks would be circular to conform to the shape of the circular ink pressure chambers, little increase in drive voltage is required if these disks are made hexagonal. Therefore, the disks can be cut from a large slab of material using, for example, a circular saw. The diameter of the inscribed circle of these hexagonal piezoceramic disks 36 is typically several thousandths of a centimeter less than the diameter of the associated pressure chamber 22, while the circumscribed circle of these disks is several thousandths of a centimeter larger. Diaphragm layer 60 is typically no more than 0.1 millimeter (0.004 inch) thick.

FIG. 6 also illustrates the arrangement wherein ink inlets 20 to pressure chambers 22 and ink outlets 24 from pressure chambers 22 are diametrically opposed. These diametrically opposed inlets and outlets provide cross flushing of the pressure chambers during filling and purging to facilitate the sweeping of bubbles from pressure chambers 22. This arrangement of inlets 20 and outlets 24 also provides the largest separation of inlets and outlets for enhanced acoustic isolation.

Thus, with the illustrated construction, the nozzles may be arranged with center-to-center spacings that are much closer than the center-to-center spacings of closely spaced and associated pressure chambers. For example, assuming the horizontal center-to-center spacing of the pressure chambers is X, the spacing of the associated nozzles is one-fourth X. For purposes of symmetry it is preferable that the nozzle-to-nozzle spacing in a row of nozzles is the inverse of the number of rows of ink pressure chambers supplying the row of nozzles. Thus, for example, if there were six rows of ink pressure chambers supplying one row of nozzles, the nozzle-to-nozzle spacing would be one-sixth X. Consequently, an extremely compact ink jet print head is provided with closely spaced nozzles. As a specific example of the compact nature of ink jet print heads of the present invention, a 96-nozzle array jet of FIG. 6 is about 9.65 centimeters (3.8 inches) long by 3.3 centimeters (1.3 inches) wide by 0.26 centimeter (0.101 inch) thick.

Bubbles are readily formed when using hot melt inks in compact print heads such as the one just described. Hot melt inks contract when solid at room temperature, drawing air through the orifices into the print head. Bubbles also form from gases dissolved in hot melt ink as it freezes in internal features of the print head, such as the pressure chambers, passages, and manifolds. Therefore, as shown in FIG. 5, purging channels 42 connect purging manifolds 44 to the nozzles 14. These optional channels and manifolds are used during initial jet filling, initial heating of previously frozen hot melt ink, and during purging to remove bubbles. Purging manifolds 44 may also be tapered to improve their purgability. A valve, 52 is connected to a purging source 51 and is used to close the purging outlet 48 and thus the purging flow path 50 when not being used. U.S. Pat. No. 4,727,378 of Le et al. discloses in greater detail one possible use of such a purging outlet. Elimination of the purging channels and outlets reduces the thickness of the ink jet print head by eliminating the plates used in defining these features of the print head.

Figure 7:
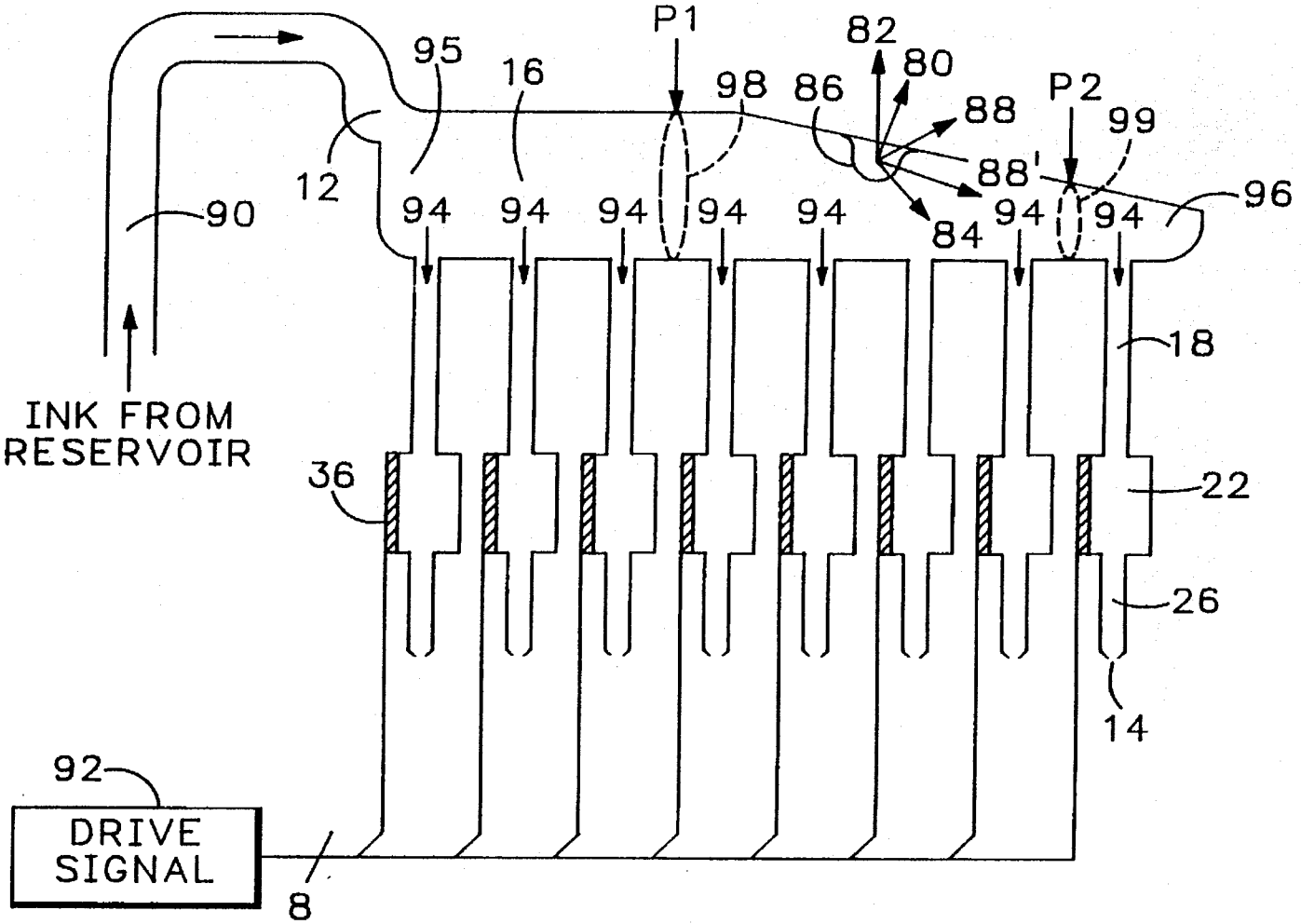
FIGS. 7, 7A, and 7B are simplified pictorial schematic views of an ink jet system according to this invention showing various forces acting on a bubble in two alternative cross-sectionally tapered manifold designs.

Referring to FIG. 7, a schematic diagram of a representative ink jet system shows arrows representing the directions of a surface tension force 80, a buoyancy force 82, and an ink flow rate-induced viscous force 84 acting on a bubble 86 present in tapered manifold 16. The forces produce an elevationally upward resultant force 88 that tends to cause bubble 86 to move within tapered manifold 16. Experience indicates that surface tension force 80 and buoyancy force 82 cause bubble 86 to adhere to upper wall of manifold 16 until overcome by viscous force 84.

In operation, ink is supplied from a reservoir (not shown) through ink communication channel 90 to ink inlet 12 and tapered manifold 16 at a predetermined inlet flow rate. A drive signal source 92 selectively drives multiple transducers 36 (eight shown) causing ink to be drawn through ink supply channels 18, into ink pressure chambers 22, through ink passages 26, and ejected from nozzles 14. The flow rate of ink into ink supply channels 18 at the locations indicated by arrows 94 is determined by the electrical drive waveform with which drive signal source 92 separately drives each of ceramic disc transducers 36. Drive signal source 92 can provide substantially identical drive waveforms to each ceramic disc transducer 36, resulting in substantially equivalent jetting characteristics from each separate nozzle. The equivalent jetting characteristics result from the acoustically equivalent design of similar features of the separate orifice channels.

During purging, a vacuum source 51 is placed in contact with nozzles 14 to cause substantially the same ink flow rate simultaneously through all ink supply channels 18, ink pressure chambers 22, ink passages 26, and nozzles 14. U.S. Pat. No. 5,184,147 to MacLane et al., for an INK JET PRINT HEAD MAINTENANCE SYSTEM, assigned to the assignee of the present invention, describes one such vacuum purging system. Alternatively, a pressure source can be applied at ink inlet 12 to achieve an equivalent result. Likewise, combinations of pressure and vacuum can be used.

The ink flow rate through ink inlet 12 is determined by the sum of all ink flow rates in ink supply channels 18 at arrows 94 and is inversely related to the cross-sectional area of ink inlet 12. Tapered manifold 16 has a base end 95 located upstream from and adjacent to the nearest upstream ink supply channel 18 and a tip end 96 located downstream from and adjacent to the farthest downstream ink supply channel 18. At a location P1 within tapered manifold 16, the ink flow rate is determined by the sum of five downstream channel flow rates at arrows 94 and depends inversely on a cross-sectional area 98 of tapered manifold 16 at location P1. At a location P2, near tip end 96 of tapered manifold 16, the ink flow rate is determined by one ink channel flow rate at arrow 94 and depends inversely on a cross-sectional area 99 of tapered manifold 16 at location P2. Cross-sectional area 99 is less than cross-sectional area 98 to compensate for differences in manifold ink flow rates at locations P1 and P2. The difference in cross-sectional areas 98 and 99 produces an ink flow rate induced downward resultant force 88' on bubble 86 that has a sufficient magnitude to overcome surface tension force 80 and buoyancy force 82 when bubble 86 is at location P2. The tapered manifold design illustrated in FIG. 7 produces a sufficiently downward resultant force 88' on bubble 86 to overcome forces 80 and 82 at all locations between base end 95 and tip end 96 of tapered manifold 16. Such an ink jet system completely purges bubbles from tapered manifold 16, through ink supply channels 18, and out nozzles 14.

As shown in FIG. 7, a continuous linear taper of at least a portion of the cross-sectional area of tapered manifold 16 is preferred. However, the taper does not have to be linear, but should be monotonically decreasing in cross-sectional area to avoid discontinuities that entrap bubbles. Of course, the taper can be applied to the entire length of tapered manifold 16. Because tapering reduces manifold volume, the cross-sectional area of base end 95 should be increased to balance manifold ink volume requirements with purging flow rate requirements.

The invention applies equally to reverse purging and back-flushing types of purging in which the ink flow is in a direction opposite to that shown and described herein.

Referring to FIGS. 5 and 8, the illustrated ink jet print head has four rows of pressure chambers 22. To eliminate the need for ink supply inlets to the two inner rows of pressure chambers from passing between the pressure chambers of the outer two rows of jets, which would thereby increase the required spacing between the pressure chambers, ink supply inlets pass to pressure chambers 22 in a plane located beneath the pressure chambers. That is, the supply inlets extend from the exterior of the ink jet to a location in a plane between the pressure chambers and nozzles. The ink supply channels then extend to locations in alignment with the respective pressure chambers and are coupled thereto from the underside of the pressure chambers.

To provide equal fluid impedances for inlet channels to the inner and outer rows of pressure channels, the inlet channels can be made in two different configurations that have the same cross-section and same overall length. The length of the inlet channels and their cross-sectional area determine their characteristic impedance, which is chosen to provide the desired performance of these jets and which avoids the use of small orifices or nozzles at inlet 20 to pressure chambers 22.

The inlet and outlet manifolds are situated outside of the boundaries of the four rows of pressure chambers. In addition, the cross-sectional dimensions of ink inlet manifolds 16 are sized and tapered to contain the smallest volume of ink and yet supply sufficient ink to the jets when all of the ink jets are simultaneously operating and to provide sufficient compliance to minimize jet-to-jet acoustic cross-talk. As described above, the ink flow rate at any point in inlet manifolds 16 depends on the number of orifice channels drawing ink downstream of that point in manifolds 16. Tapered inlet manifolds 16, which have reduced cross-sectional areas as a function of the number of ink supply channels downstream of various locations in the inlet manifolds, therefore regulate the ink flow rate to provide a substantially constant flow rate at all locations. Therefore, during purging, the flow rate at any point in manifolds 16 is sufficiently high to sweep bubbles from the manifolds.

Although multiple ink supply channels are supplied with ink from manifolds 16, the print head design of the present invention provides acoustic isolation between ink pressure chambers 22 coupled to common manifolds. Ink supply manifolds 16 and ink supply channels 18 function together as acoustic resistance-capacitance circuits that damp acoustic pressure pulses. These pressure pulses otherwise could travel back through the inlet channel from the pressure chamber in which they were originated, pass into the common manifold, and then into adjacent inlet channels to adversely impact the performance of adjacent jets.

In the present invention, tapered manifolds 16 are sized to provide a relatively large fluid compliance which, in combination with the acoustic resistance of inlet channels 18, provides acoustic isolation among pressure chambers 22. Tapered manifolds 16 not only exhibit improved purging characteristics, but the removal of acoustically reflective bubbles improves acoustic isolation and jetting uniformity. Tapering the manifolds creates randomized acoustic reflection paths within the manifolds that increase acoustic isolation and retard the development of acoustic standing waves caused by simultaneous operation of multiple jets. Such acoustic isolation prevents alteration of the ink drop ejection characteristics of any jet by any operating combination of other ink jet or jets connected to the same manifold.

Figure 8A:
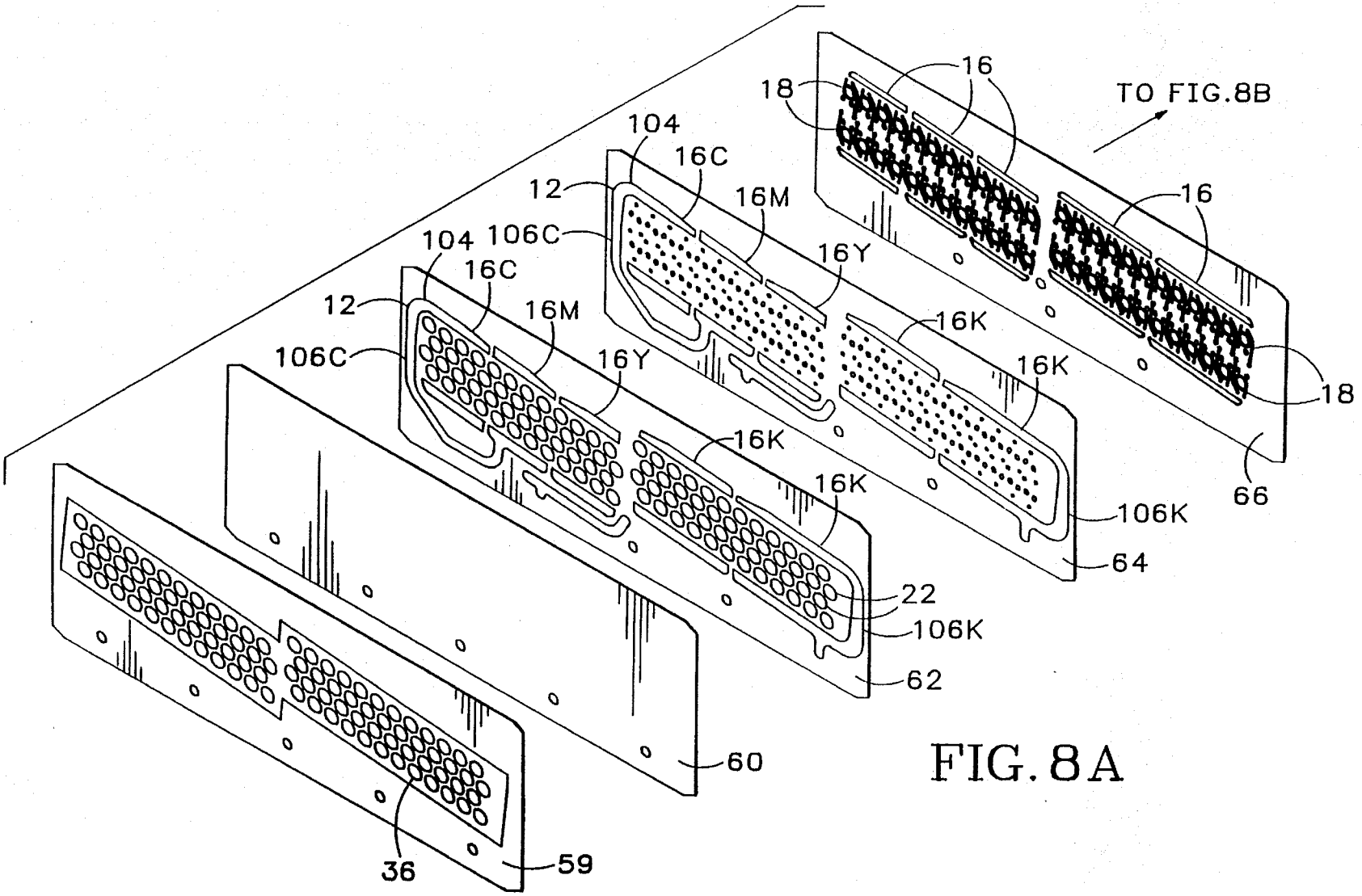
FIGS. 8A and 8B together form an exploded isometric view of the various layers of an array-type of ink jet print head having two arrays of 48 nozzles each supplied with ink from tapered manifolds designed in accordance with one embodiment of this invention.
Figure 8B:
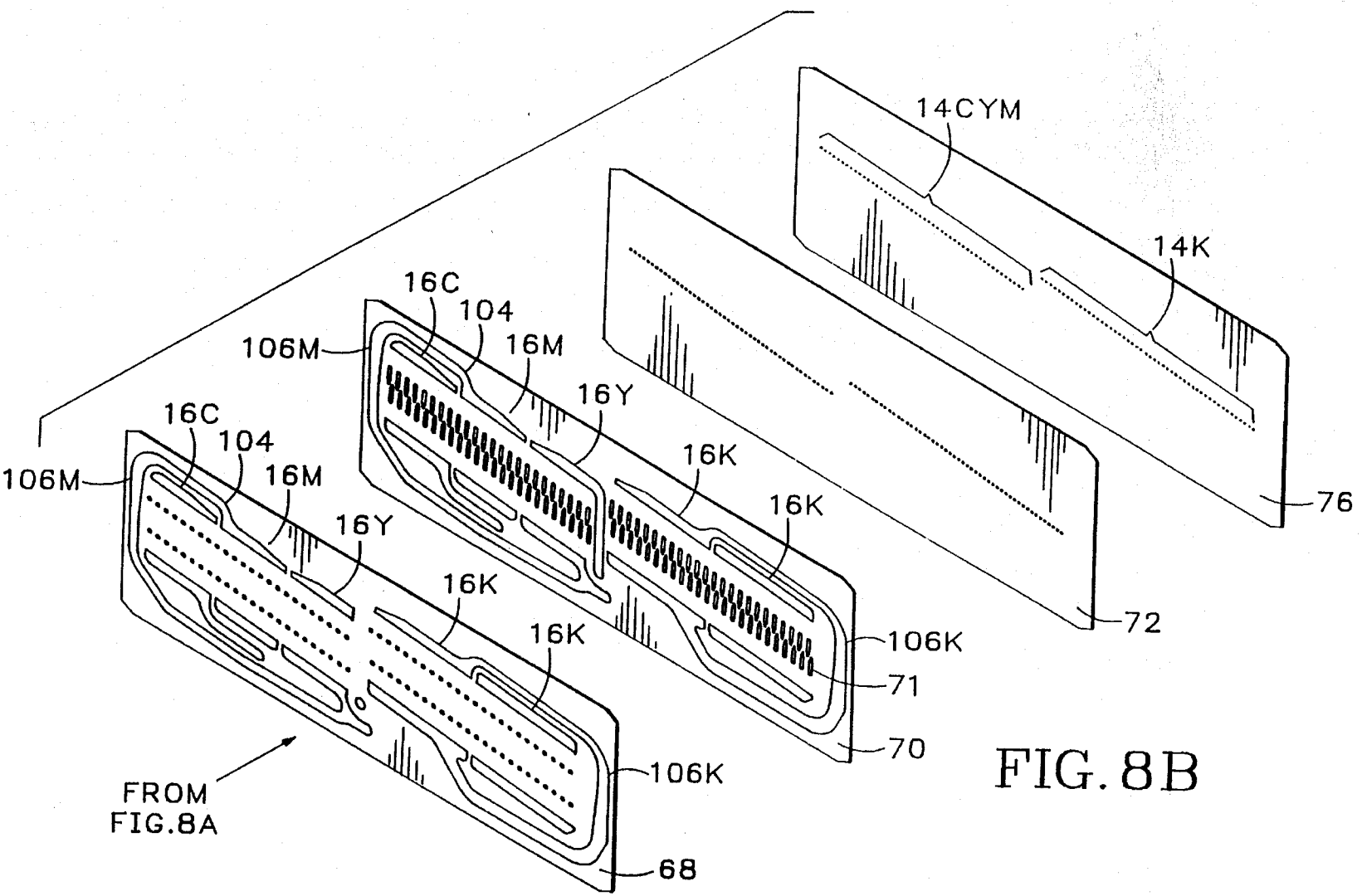

The ink jet print head illustrated in FIGS. 8A and 8B has a row of 48 nozzles 14K that are used to print black ink. This ink jet print head also has a separate, horizontally offset row of 48 nozzles 14CYM that are used to print colored ink. Sixteen of the latter row of 48 nozzles are used for cyan ink, 16 for magenta ink, and 16 for yellow ink. Hereafter, enumerated features will be further identified, as needed, with an ink color suffix indicative of cyan C, yellow Y, magenta M, or black K ink. The ink jet print head layout can be readily modified to have all of nozzles 14 in a single line rather than a dual line. None of the operating characteristics of the ink jet print head would be affected by this modification.

The ink jet print head configuration illustrated in FIGS. 8A and 8B is used in a commercially successful color ink jet printer. Improvements have been made based on experience with the design. Most notably, printing speed was increased by adding more nozzles 14 to the head. But, it was found that cross-sectional areas 98 and 99 of ink supply manifolds 16 were too small, causing a significant ink pressure loss along the length of manifolds 16 when additional nozzles 14 operate simultaneously. With added nozzles, less ink is delivered to nozzles 14 than is desired for uniform jetting. Therefore, it was necessary to make additional changes to the print head design.

For example, referring to FIGS. 7 and 8, a tapered upper cyan manifold 16C has an ink flow rate stagnation region near ink supply channels 18 adjacent to ink inlet 12. Bubbles in the vicinity of ink flow stagnation regions are difficult to purge because there is an insufficient ink flow rate to move them to a point in ink supply manifolds 16 where they can be swept from the ink jet head by downward resultant force 88'. A tapered upper magenta manifold 16M and tapered upper cyan manifold 16C have elevationally high points 104 where bubbles tend to accumulate. There are no ink supply channels 18 adjacent to elevationally high points 104 through which bubbles can be purged without using a large volume of rapidly moving ink during a purge cycle.

Ink supply manifolds 16 each communicate with a relatively long ink communications channel 106 of essentially uniform cross-sectional area in which standing pressure waves can form. Standing pressure waves are undesirable because they contribute to jet-to-jet acoustic cross-talk as described above.

Manifolds 16 and their associated ink communications channels 106 have a combined length and cross-sectional area containing a significant volume of ink requiring purging during a purge cycle. The amount of ink required to completely purge an ink jet head can be expressed in terms of the number of print head volumes of ink required for a purge cycle. Because of the above-described ink flow rate stagnation region, multiple volumes of ink are often required to completely purge the above-described ink jet head. Moreover, the inks used are preferably of a costly hot-melt type that have high chromaticity and brightness. Purging cycles that use excessive quantities of these inks are relatively costly and therefore undesirable.

Figure 9:
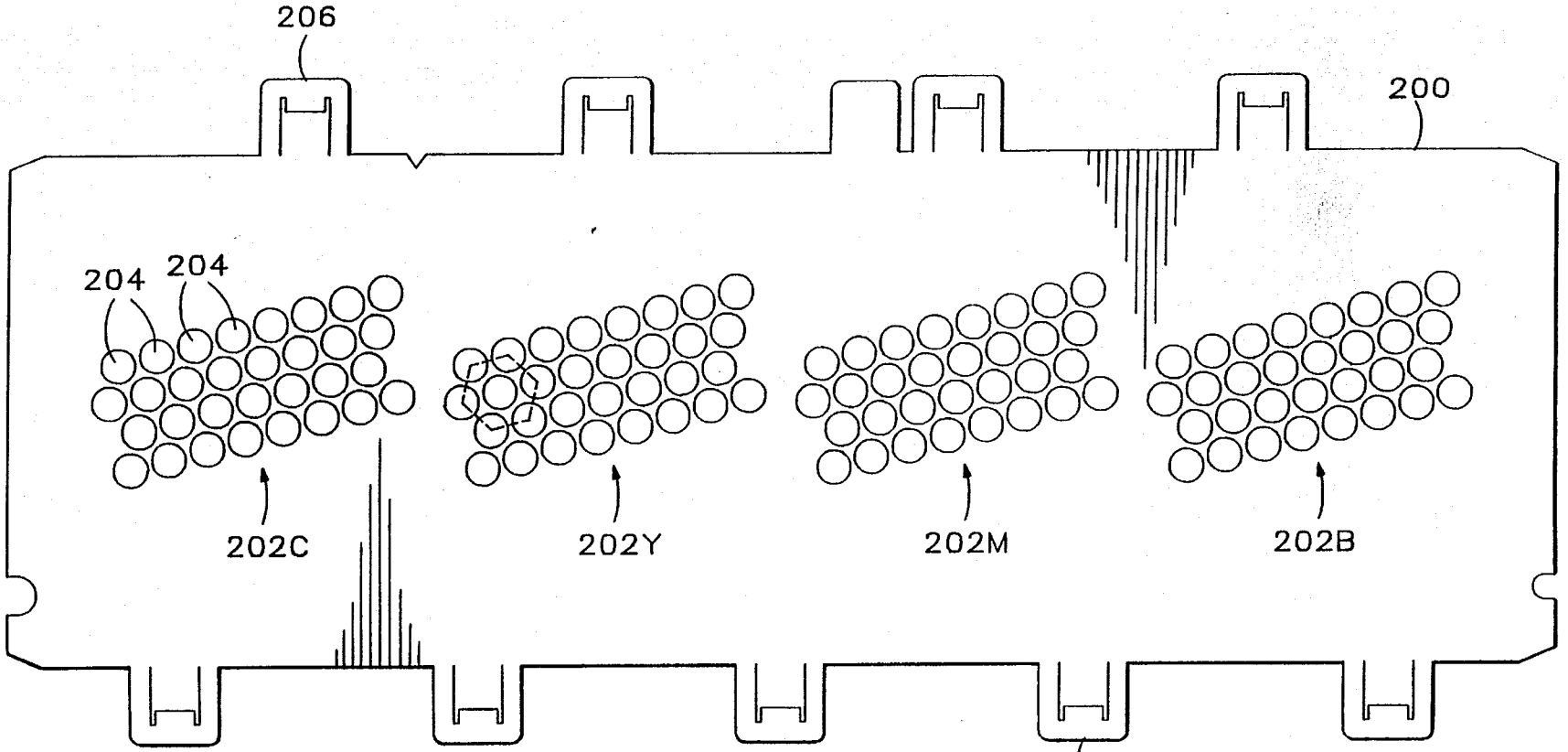
FIGS. 9–11 are frontal plan views showing representative plates forming an alternate embodiment of the array-type of ink jet head.
Figure 10:
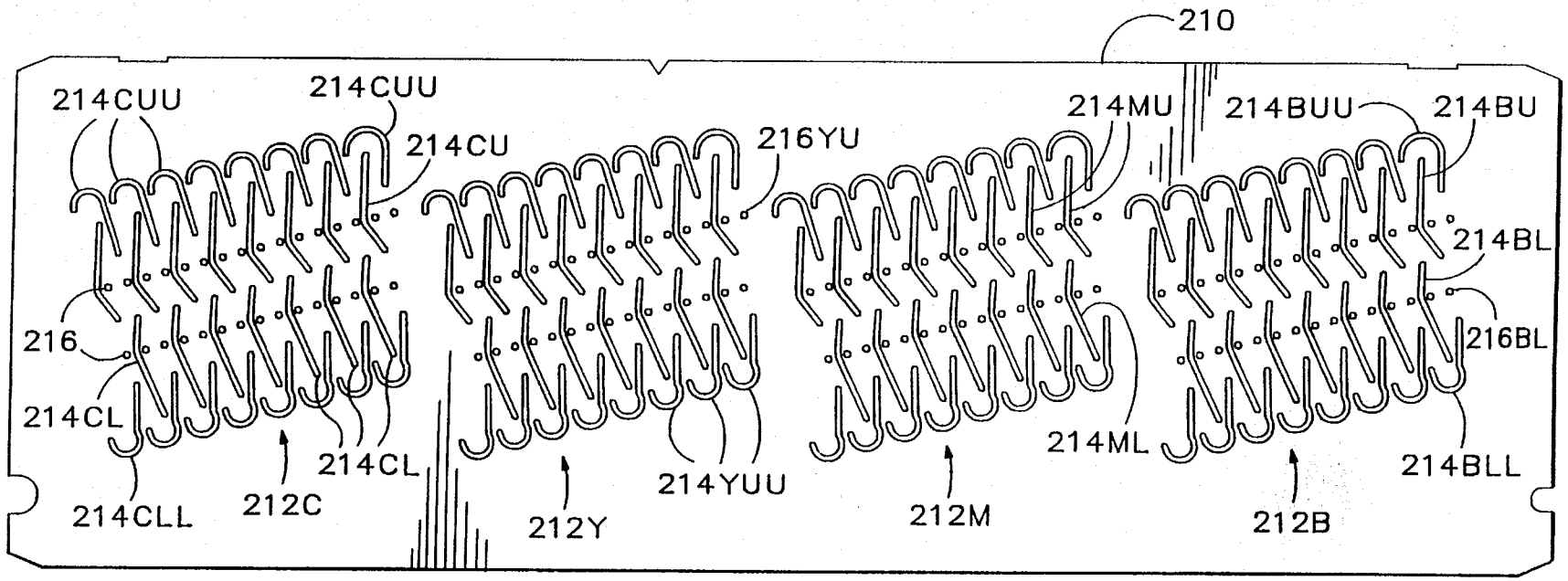
Figure 11:
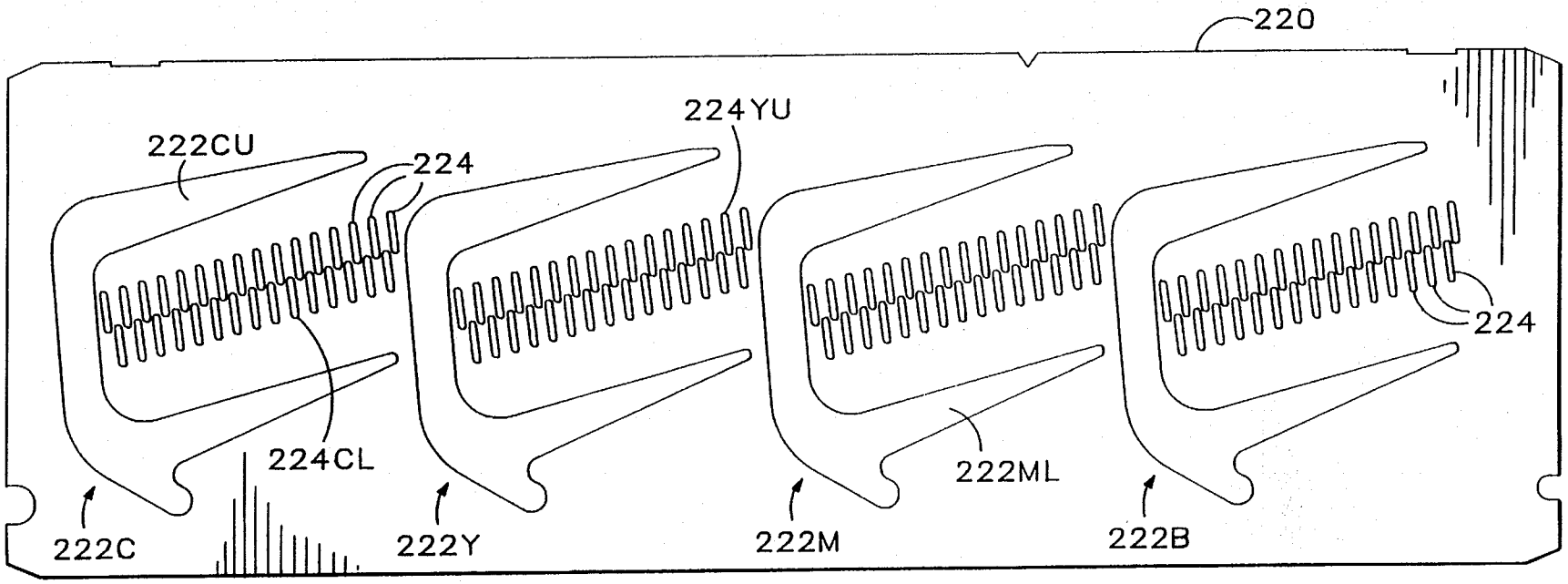

FIGS. 9–11 show frontal plan views of representative plates forming a preferred embodiment of an improved array-type ink jet head with a design that reduces many of the above-described problems, while increasing the number of jets. In particular, FIG. 9 shows an ink pressure chamber plate 200 forming four subarrays 202C, 202Y, 202M, and 202B of ink pressure chambers 204. Each sub-array 202 has 31 ink pressure chambers 204 located on a hexagonal grid (illustrated with dashed lines). Ink pressure chamber plate 200 also has nine mounting tabs 206 by which the assembled ink jet head is attached to a source of ink (not shown).

FIG. 10 shows an ink supply channel plate 210 forming four subarrays 212C, 212Y, 212M, and 212B of ink supply channels 214. Ink supply channels 214 are of four configurations hereafter designated with upper-upper (UU), upper (U), lower (L), and lower-lower (LL) suffixes. Particular ink supply channels are numerically designated as, for example, upper-upper cyan ink supply channel 214CUU and lower magenta ink supply channel 214ML. All ink supply channels 214 have substantially the same lengths and cross-sectional areas regardless of their configuration.

Ink supply channel plate 210 also has 31 ink pressure chamber outlets 216 of upper (U) and lower (L) types in each subarray 212. Particular ink pressure chamber outlets are numerically designated as, for example, upper yellow ink pressure chamber outlet 216YU and lower black ink pressure chamber outlet 216BL.

FIG. 11 shows an ink supply manifold plate 220 forming four ink supply manifolds 222C, 222Y, 222M, and 222B. Ink supply manifolds 222 include two subsections hereafter designated upper (U) and lower (L). Particular ink supply manifold subsections are designated as, for example, upper cyan ink supply manifold 222CU and lower magenta ink supply manifold 222ML.

Ink supply manifold plate 220 also has 31 ink passages 224 of upper (U) and lower (L) types in each subarray 212. Particular ink passages are numerically designated as, for example, upper yellow ink passage 224YU and lower cyan ink passage 224CL.

Figure 12:
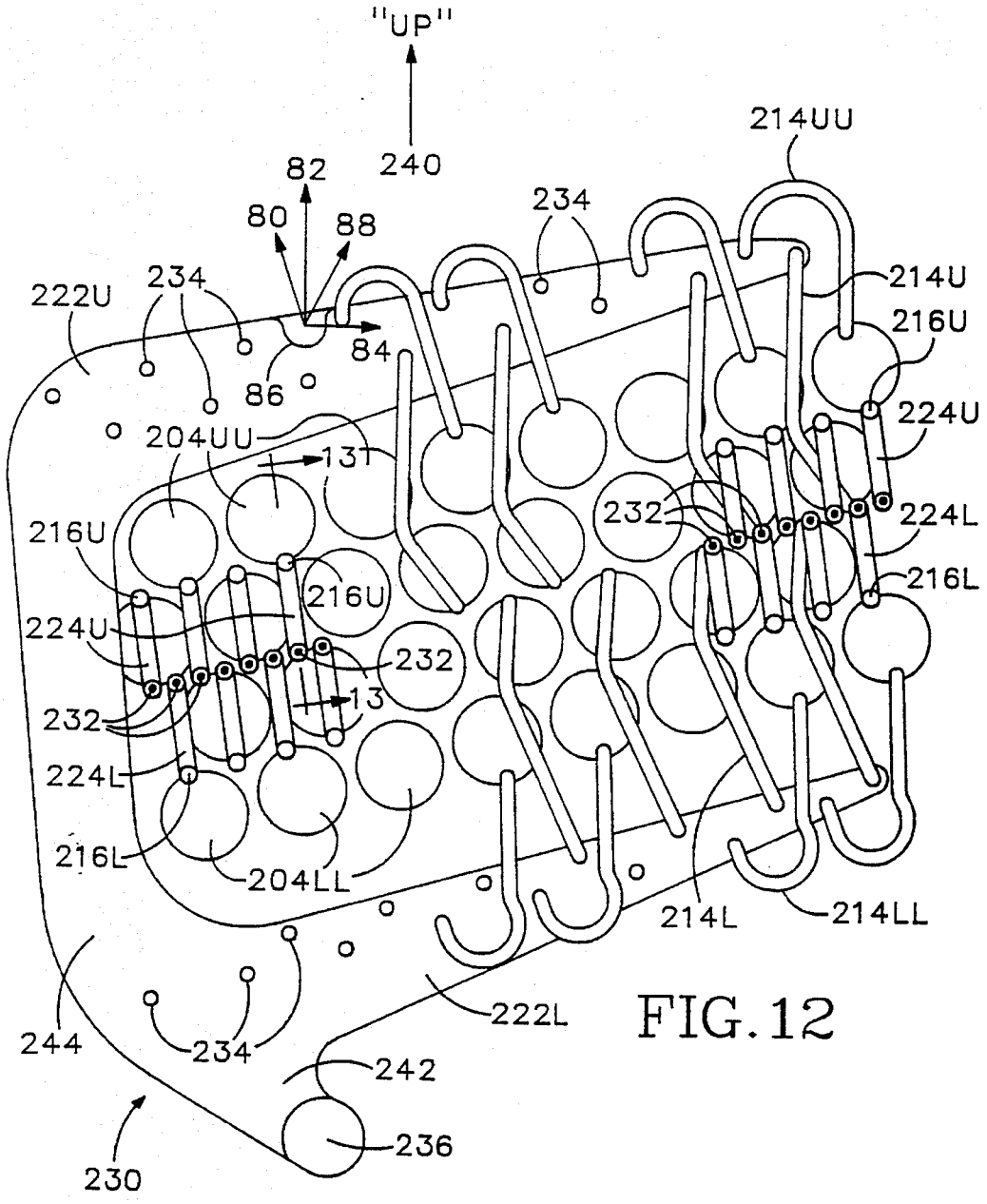
FIG. 12 is an enlarged composite plan view showing a subhead array of the alternate embodiment of this invention, with selected features eliminated to reveal the interrelationship and spacial orientation of features in the path of ink flow.

FIG. 12 is an enlarged composite plan view of a representative subhead array 230 of the alternate embodiment of this invention. Subhead array 230 is shown with selected features eliminated to reveal the interrelationship and spacial orientation of manifolds 222, ink supply channels 214, ink pressure chambers 204, ink pressure chamber outlets 216, and ink passages 224. Also shown is a partial row of 31 nozzles 232 formed by a nozzle plate (not shown), a set of ports 234 through which ink flows from ink supply manifolds 222 into ink supply channels 214, and an ink inlet 236. All of the main features associated with the right-most eight nozzles 232 are shown.

In operation, subhead array 230 is oriented vertically such that the direction of "up" arrow 240 is perpendicular to the surface of the earth. Ports 234 are distributed throughout manifolds 222U and 222L in a staggered manner, with about half of them adjacent to the upper sides of manifolds 222. Manifolds 222 are tapered and are arranged to slope in a generally elevationally upward direction with respect to a direction perpendicular to up arrow 240.

A bubble 86 entrapped in manifold 222U, or similarly for manifold 222L, is subject to surface tension force 80, buoyancy force 82, and viscous force 84 as previously described with reference to FIG. 7. However, because manifolds 222 are sloped elevationally upward, viscous force 84 does not have to overcome forces 80 or 82 to produce movement of bubble 86. Therefore, a relatively low ink flow rate is sufficient to cause bubble 86 to migrate toward and along the elevationally higher upper side of manifold 222U, where it can be swept into one of ports 234. Ink inlet channels 214UU and 214L have upward oriented first sections to further assist in sweeping bubbles from manifolds 222. Because ink inlet channels 214UU and 214L have relatively small cross-sectional areas, supply channel ink flow rate is sufficient to sweep bubbles through ink pressure chambers 204 and out nozzles 232.

Such a design sweeps away smaller bubbles during normal operation and effectively purges larger bubbles formed as a result of freeze/melt cycles of the hot-melt ink. Purging cycles require a relatively low vacuum or pressure to create a sufficient purge flow rate, and require a minimum volume of ink. Even with the increased number of jets, less ink is wasted during a purge cycle than with prior designs.

Figure 13:
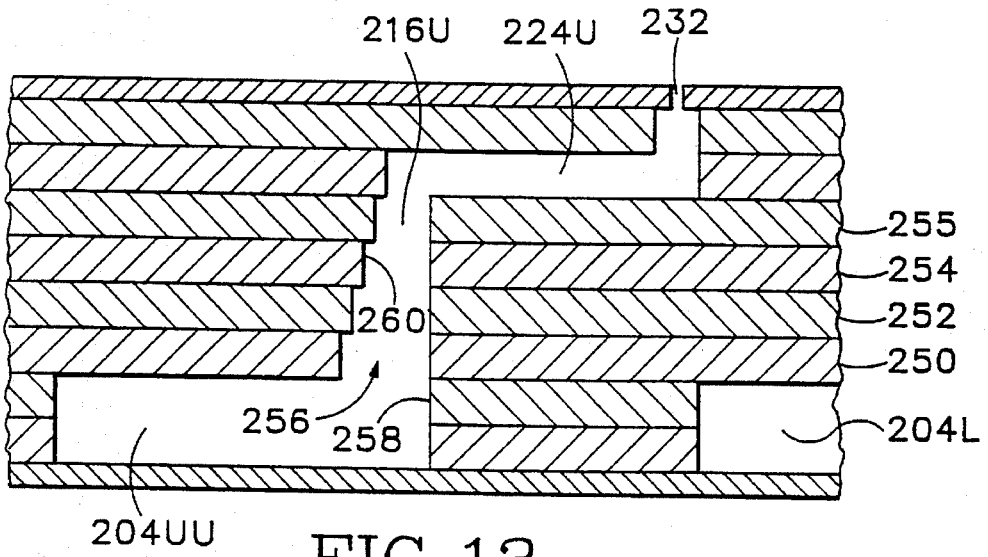
FIG. 13 is an enlarged cross-sectional view showing the plate construction features of an ink pressure chamber, tapered ink outlet, ink passage, and nozzle taken through portions of the subhead array of FIG. 12.

FIG. 13 shows an enlarged cross-sectional view of ink pressure chamber 204UU, ink outlet 216U, ink passage 224U, and nozzle 232 taken along line 13—13 of FIG. 12, and is representative of a typical one of the multiple ink jets shown in FIG. 12. FIG. 13 shows the above-described features formed by laminated plates. In particular, ink outlet 216U is formed from plates 250, 252, 254, and 255, with the portion of ink outlet 216U formed by each plate having a progressively smaller cross-sectional area in the direction of ink flow indicated by an arrow 256. Any appropriate geometric shape could be employed, as long as the progressively smaller cross-sectional area tapering is utilized in the direction of flow. The portions of ink outlet 216U formed by plates 250, 252, 254, and 255 are preferably of a generally annularly-tipped channelled or dotted cross-section, having foci spaced apart respectively 0.15, 0.10, and 0.05 millimeter (0.006, 0.004, and 0.002 inch), and with each having a 0.416 millimeter (0.016 inch) radius from each of the foci. The portion of ink outlet 216U formed by plate 255 is preferable of circular cross-section with a radius matched to that of the other plates forming ink outlet 216U. Thereby, ink outlet 216U is stepwise tapered to reduce ink flow rate stagnation in the transition from ink pressure chamber 204UU into ink passage 224U, and to relax the registration and alignment tolerances required when laminating together ink inlet forming plates 250, 252, 254, and 255. Ink outlet 216U is shown with a straight wall 258 and a stepped wall 260. Alternatively, both walls could be stepped and ink outlet 216U could have a generally oval or circular cross-section. The cross-sectional area can also taper from round-to-oval or vice versa. Such tapering can also be applied to other cross-sectional area transitions of subhead array 230, such as those associated with ports 234, nozzles 232, or ink supply channels 214. A series of concentric circles with decreasing diameter in the direction of flow in the inlet forming plates 250, 252, 254, and 255 could also be employed to achieve the tapered design.

The improved design of the alternate embodiment eliminates ink flow rate stagnation regions in manifolds 222. Ink flow direction during normal operation and purge cycles tends to sweep entrapped bubbles toward ports 234 into ink inlet channels 214 by operation of ink pressure chambers 204. Ink pressure chambers 204 expel ink into ink passages 224 and out through nozzles 232. Manifolds 222 are tapered to retard standing pressure waves that can develop during sustained operation of multiple jets. If formed from multiple manifold forming plates 220 (FIG. 11), manifolds 222 can be tapered in combinations of their width and depth dimensions. In general, tapering is applied to cross-sectional areas of a manifold with the degree of tapering expressed as an area ratio $a_r$ of the cross-sectional areas at opposite ends of the manifold. As described for the first embodiment, tapering provides a more uniform ink flow rate profile through the manifold, improving purging performance.

Manifolds 222 are relatively short, reducing the ink volume required in a purge cycle and increasing the acoustic standing wave frequency (above the jet repetition rate) to reduce cross-talk. The cross-sectional areas of manifolds 222 are large enough to supply required amounts of ink to nozzles 232 without a significant pressure loss along the lengths of manifolds 222.

The improved design is optimized for a particular ink jet head application based on many variables including manifold geometry, degree of manifold taper, fluid properties of the ink, number of jets, and the maximum jet firing rate. Area ratio $a_r$, cross-sectional area, and length of a main manifold ink supply 242 and an upper manifold ink supply 244 affect the jetting and purging performance of a print head.

Figure 14:
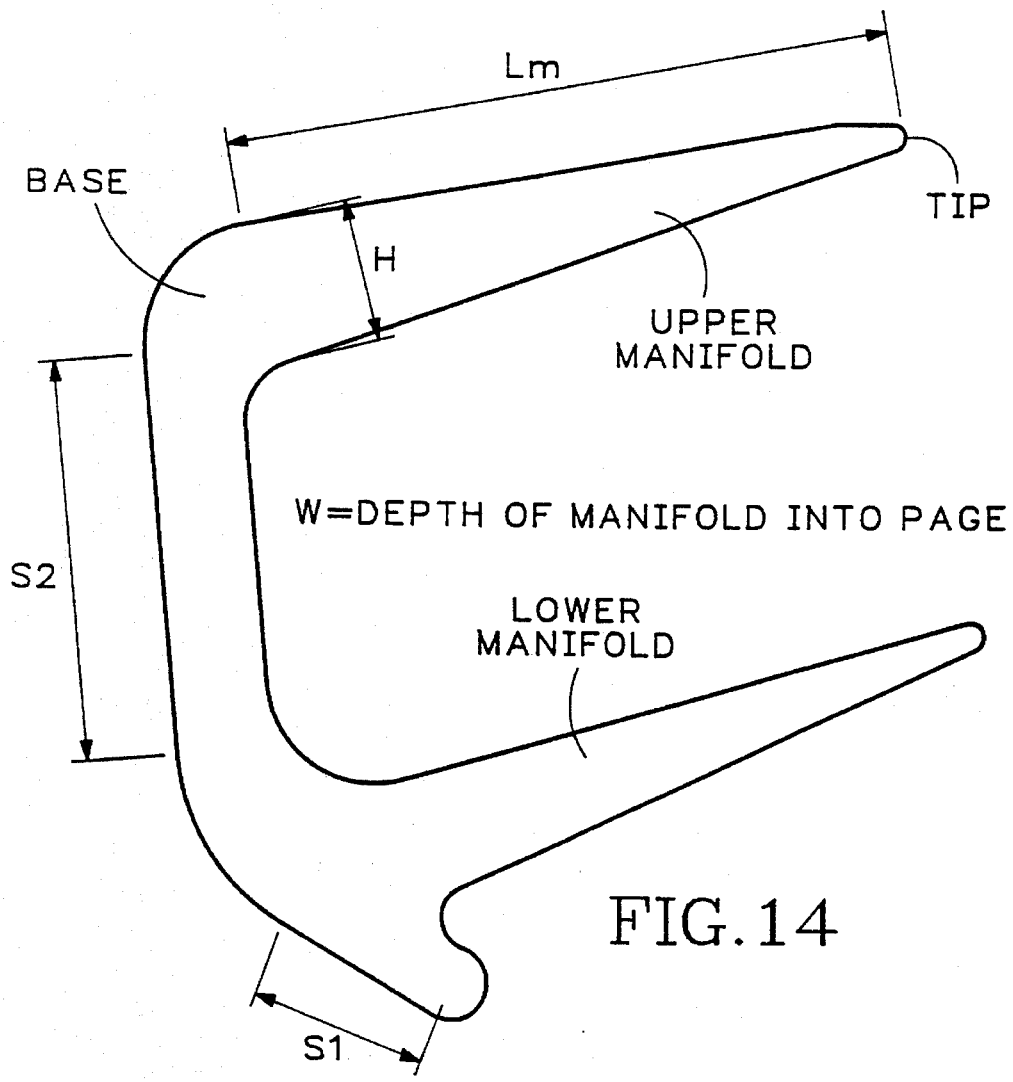
FIG. 14 shows an ink supply manifold according to this invention with its geometric dimension variables labeled.

Skilled workers will recognize that various ink jet head operating parameters depend on particular printing applications, and that many of the parameters given below are merely exemplary of one possible embodiment of an improved ink jet head design. A wide variety of inks, maximum jet operating rates, orifice array configurations, and printer architectures exist from which skilled workers must select a best combination of variables to suit a particular printing application. FIG. 14 and Tables 1, 2, 3, and 4 illustrate and provide definitions and base values for the various ink manifold related variables that form the basis for a preferred ink jet head design.

TABLE 1

| Definition of variables | |
|---|---|
| $a$ = | Acoustic velocity |
| $A_b$ = | Manifold cross-sectional area at base |
| $a_r$ = | Tip/base area ratio |
| $A_t$ = | Manifold cross-sectional area at tip |
| $C_{tm}$ = | Tapered manifold frequency constant |
| $D_{bub}$ = | Bubble diameter |
| $f$ = | Manifold natural frequency |
| $f_{lm}$ = | Frequency of lower manifold |
| $f_{um}$ = | Frequency of upper manifold |
| $F_b$ = | Buoyant force on bubble |
| $f_D$ = | Force on bubble due to viscous drag |
| $f_{max}$ = | Maximum jet repetition frequency |
| $g$ = | Acceleration due to gravity |
| $H$ = | Manifold height at base |
| $L_m$ = | Manifold length |
| $M_d$ = | Total ink drop mass for $N_{jet}$ drops |
| $m_d$ = | Drop mass for an individual drop |
| $M_{dot}$ = | Total mass flow for $N_{jet\ drops}$ |
| $m_{dot}$ = | Mass flow for an individual jet |
| $M_{man}$ = | Mass of ink in manifold |
| $M_{purge}$ = | Mass flow rate for purge |
| $\mu$ (mu) = | Fluid viscosity |
| $N_{jet}$ = | Number of jets per manifold |
| $P$ = | Perimeter of manifold cross-section at base |
| $P_T$ = | Transient pressure fluctuation |
| $Re_D$ = | Reynolds number |
| $R_h$ = | Hydraulic radius |
| $\rho$ (rho) = | Fluid density |
| $S_1$ = | Main manifold supply length |
| $S_2$ = | Upper manifold supply length |
| $U_{ave}$ = | Average fluid velocity |
| $U_{cross}$ = | Cross manifold fluid velocity |

TABLE 1-continued

| Definition of variables | |
|---|---|
| W = | Manifold width (depth) |

Table 2 lists fluid property values of an exemplary hot-melt ink and the value of the acceleration due to gravity g.

TABLE 2

| Fluid Properties of Exemplary Ink | |
|---|---|
| ρ (rho) = | Fluid density = 0.85 grams/cm$^3$ |
| a = | Acoustic velocity = 100,000 cm/sec |
| μ (mu) = | Fluid viscosity = 0.15 poise |
| g = | Acceleration of gravity = 981 cm/sec$^2$ |

Table 3 lists exemplary manifold geometry values for the variables listed in Table 1 and shown in FIG. 14. Note that area ratio $a_r$ is defined as the ratio of the cross-sectional areas of the manifold at its tip and base. Ten values for $a_r$ ranging from 0.1 (10.1 taper) to 1.0 (1:1, or no taper) are used in the calculations below.

TABLE 3

| Manifold Geometry | |
|---|---|
| W = | 0.20 cm |
| H = | 0.41 cm |
| $A_b$ = | W*H = 0.08 cm$^2$ |
| $a_r$ = | 0.1 to 1.0 in steps of 0.1 |
| $A_t(a_r)$ = | $a_r$*$A_b$ |
| P = | 2 (W + H) = 0.16 cm |
| $L_m$ = | 1.91 cm |
| $S_1$ = | 0.64 cm |
| $HS_1$ = | 0.18 cm |
| $PS_1$ = | 2 ($S_1$ + $HS_1$) = 1.64 cm |
| $AbS_1$ = | $S_1$*$HS_1$ = 0.12 cm$^2$ |
| $S_2$ = | 1.52 cm |
| $HS_2$ = | 0.23 cm |
| $PS_2$ = | 2 ($S_2$ + $HS_2$) = 3.5 cm |
| $AbS_2$ = | $S_2$*$HS_2$ = 0.35 cm$^2$ |

Table 4 lists ink drop parameter values based on typical ink drop sizes and an exemplary maximum jetting rate. The ink drop volume is determined by the nozzle diameter and the amount of energy transferred into each pressure chamber by its associated drive transducer.

TABLE 4

| Exemplary Ink Jet Rate and Drop Mass Parameters | |
|---|---|
| $f_{max}$ = | 8,000 drops per second |
| $V_d$ = | 200*10$^{-9}$ cubic centimeters |
| $m_d$ = | ρ*$V_d$ = 1.7 10$^{-7}$ grams |
| $m_{dot}$ = | $m_d$*$f_{max}$ = 0.0014 grams/sec |
| $N_{jet}$ = | 16 |
| $M_d$ = | $N_{jet}$*$M_d$ = 2.72 10$^{-6}$ grams |
| $M_{dot}$ = | $N_{jet}$*$m_{dot}$ = 0.022 grams/sec |

Mathematical relationships used to determine dimensions for the exemplary improved ink jet head design are described below.

Jetting performance of an ink jet head is improved if the natural resonant frequency of the manifold is above the maximum repetition rate at which the jets are operated. The ink inlet or communications channels 106 and the ink supply manifolds 16 each have a length and cross-sectional area that combined caused them to naturally resonate at a frequency above a maximum repetitive operating frequency at which the nozzles or jets are operated. The laws of physics state that organ pipe frequencies can be calculated as f=a/kl where "a" is the speed of sound in the fluid, and "l" is the length of the pipe. The constant "k" is 2 for a pipe with both ends closed, and 4 for a pipe with one end open.

If the exemplary manifold design is untapered, the calculations below show that the natural frequency of the upper manifold and associated ink supply is below the exemplary maximum repetition rate of 8 kHz. The lower, upper, and combined manifold natural frequencies are calculated according to the following equations:

$$f_{lm} = \frac{a}{4(S_1 + L_m)} = 9.843 \times 10^3 \text{ Hz}$$

$$f_{um} = \frac{a}{4(S_1 + S_2 + L_m)} = 6.152 \times 10^3 \text{ Hz}$$

$$f_{cm} = \frac{a}{2(S_2 + 2L_m)} = 9.374 \times 10^3 \text{ Hz}$$

Tapering the upper and lower manifolds increases their natural resonant frequencies. The natural frequency calculations are again based on the formula f=a/kl, but with $C_{tm}$, substituted for k, where $C_{tm}$ is a function of area ratio $A_r$ as shown below.

$$A_r = \begin{bmatrix} 0.2 \\ 0.4 \\ 0.6 \\ 0.8 \\ 1.0 \end{bmatrix}$$

$$C_{tm} = \begin{bmatrix} 2.4 \\ 2.9 \\ 3.2 \\ 3.6 \\ 4.0 \end{bmatrix}$$

The lower and upper manifold natural frequencies are calculated according to the following equations:

$$F_{lm}(a_r) = \frac{a}{C_{tm}(S_1 + L_m)}$$

$$f_{um}(a_r) = \frac{a}{C_{tm}(S_1 + S_2 + L_m)}$$

Figure 15:
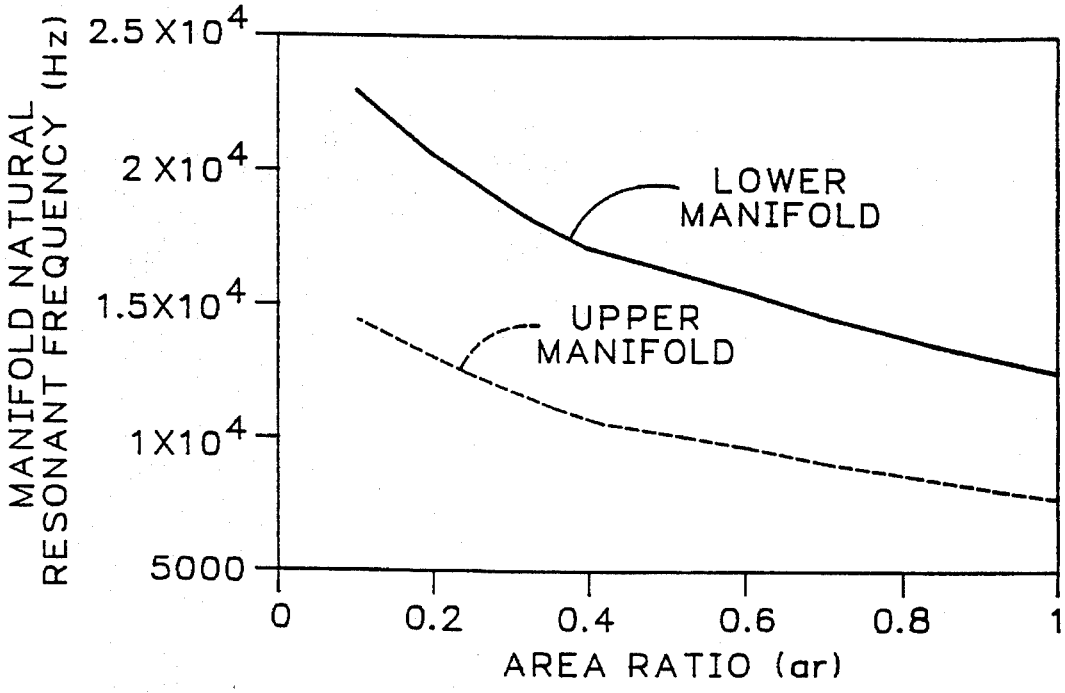
FIG. 15 graphically shows manifold natural resonant frequencies of a manifold as a function of manifold area ratio (degree of taper).

FIG. 15 graphically shows the results of the above calculations when the natural frequencies of the upper and lower manifolds are graphed as a function of area ratio. The natural frequency of the upper manifold is increased to greater than 10 kHz when tapered with a 0.2 area ratio, which is above the exemplary maximum jet operating rate of 8 kHz.

Unfortunately, tapering a manifold increases the steady-state pressure loss along the length of the manifold and contributes to nonuniform jetting performance. For an untapered manifold, steady-state pressure loss $P_L$ is determined by a laminar flow calculation, and shows a relatively small pressure loss from the base to the tip of the upper and lower manifolds. The formulas below model the manifolds conservatively as a simple pipe with only entrance and exit flows and assume all jets are operating simultaneously. The lower and upper manifold pressure loss is calculated according to the following equations:

$$P_L = \frac{\rho U_{ave}^2}{2}(f)\frac{L_m}{D_h} + \frac{\rho U_{aveS1}^2}{2}(F_{S1})\frac{S1}{D_{hS1}} = 98.66 \text{ dynes/cm}^2$$

$$P_L = \frac{\rho U_{ave}^2}{2}(f)\frac{L_m}{D_h} + \rho U_{aveS1}^2(f_{S1})\frac{S1}{D_{hS1}} + \frac{\rho U_{aveS2}^2}{2}(f_{S2})\frac{S2}{D_{hS2}} = 175.5 \text{ dynes/cm}^2$$

where the $D_h$, $U_{ave}$, $Re_D$, and f factors are calculated according to the following equations:

$$D_h = 4\frac{A_b}{P},\ D_{hS1} = 4\frac{A_{bS1}}{P_{S1}},\ D_{hS2} = 4\frac{A_{bS2}}{P_{S2}}$$

$$U_{ave} = \frac{M_{dot}}{\rho A_b},\ U_{aveS1} = \frac{M_{dot}}{\rho A_{bS1}},\ U_{aveS2} = \frac{M_{dot}}{\rho A_{bS2}}$$

$$Re_D = \frac{\rho U_{ave} D_h}{\mu},\ Re_{DS1} = \frac{\rho U_{aceS1} D_{hS1}}{\mu},\ Re_{DS2} = \frac{\rho U_{aveS2} D_{hS2}}{\mu}$$

$$f = \frac{64}{Re_D},\ f_{S1} = \frac{64}{Re_{DS1}},\ f_{S2} = \frac{64}{Re_{DS2}}$$

In addition to steady-state pressure loss, transient pressure fluctuation $P_T$ needs to be considered. In a tapered manifold, simultaneous firing of all jets causes a significant pressure fluctuation along the length of the manifold, and leads to nonuniform jetting. Transient pressure fluctuation in a tapered manifold is determined by calculating the mass of ink contained in the manifold and the mass of ink lost when all jets are operated simultaneously. Transient pressure fluctuation $_{PT}$ is calculated as a function of $a_r$ for the upper and lower manifolds according to the following equations:

$$P_{Tu}(a_r) = \rho(a^2)\frac{Md}{M_u(a_r)}$$

$$P_{Tl}(a_r) = \rho(a^2)\frac{Md}{M_l(a_r)}$$

where the mass of ink in the upper and lower manifolds is calculated by the following equations:

$$M_u(a_r) = \rho W\left(H\frac{1+a_r}{2} + L_m + S1 + H_{S1} + S2 + H_{S2}\right)$$

$$M_l(a_r) = \rho W\left(H\frac{1+a_r}{2} + L_m + S1 + H_{S1}\right)$$

Figure 16:
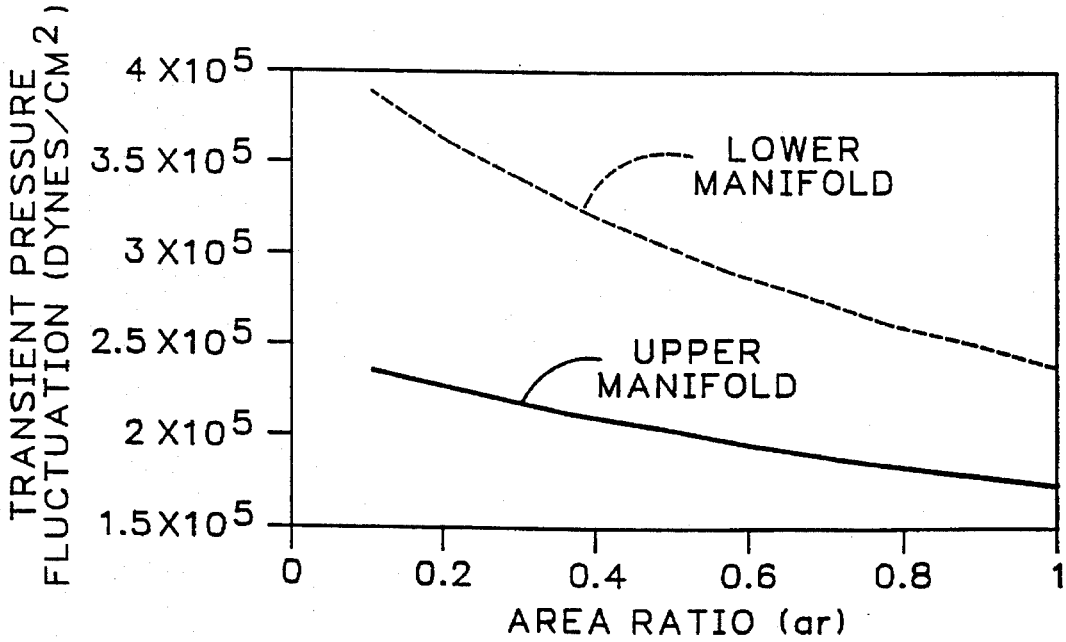
FIG. 16 graphically shows transient pressure fluctuation in a manifold as a function of manifold area ratio (degree of taper) when all jets are fired once.

FIG. 16 graphically shows the results of the above calculations. As expected, upper and lower manifold transient pressure fluctuation $P_T$, graphed as a function of area ratio $a_r$, shows that transient pressure fluctuation is greater in tapered manifolds than in untapered manifolds.

Tapering the manifolds appears to increase both steady-state pressure loss and the transient pressure fluctuation by a small and acceptable amount. Increasing the volume of the manifolds to decrease the pressure losses and fluctuations also decreases their natural resonant frequencies. Therefore, a tolerable amount of transient pressure loss and fluctuation must be balanced against the natural resonant frequency when designing a manifold. A satisfactory compromise for the improved tapered manifold resulted in a design having a tapered manifold volume equivalent to that of an untapered manifold.

Ink purge flow rate $U_{purge}$ is another factor in manifold design. Tapering a manifold helps maintain higher ink purge flow rates at various locations x along the length of the manifold. A generally higher ink purge flow rate increases viscous drag on bubbles and improves their purgability as described with reference to FIGS. 7 and 12. Ink purge flow rate is calculated according to the following equation:

$$U_{purge}(a_r, x) = \frac{M_{purge}}{\rho A_c(a_r, x)}(1-x)$$

Where: x is linearly stepped from 0 (base) to 1 (tip) in steps of 0.1, $M_{purge}$=0.5 grams/sec, and $A_c(a_r,x)=xA_t(a_r)+(1-x)A_b$.

Figure 17:
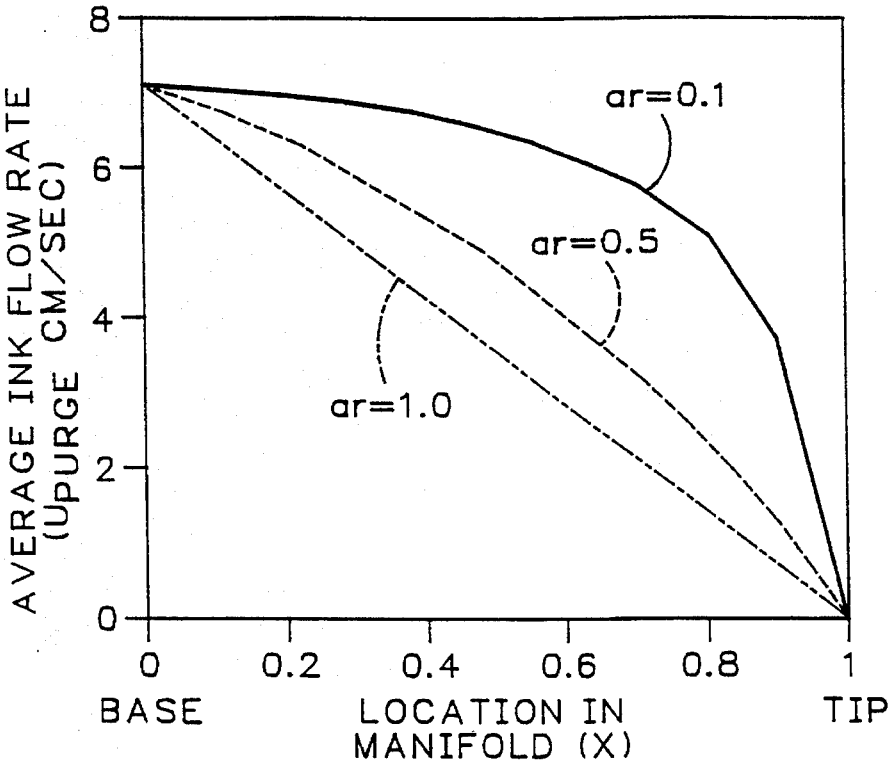
FIG. 17 graphically shows ink flow rate profiles in a manifold as a function of distance from the base toward the tip of three different manifolds each having different area ratios.

FIG. 17 graphically shows the results of the above calculations. Average ink purge flow rate is graphed as a function of locations x in the manifold and shows that ink purge flow rate in an untapered manifold ($a_r$=1.0) decreases linearly from its base to the tip, whereas a 10:1 tapered manifold ($a_r$=0.1) maintains a substantially uniform ink purge flow rate for most of its length. Even a 2:1 taper ($a_r$=0.5) has a beneficial regulating effect on ink purge flow rate. In the exemplary manifold design, a 5:1 taper ($a_r$=0.2) is preferred.

Figure 7A:
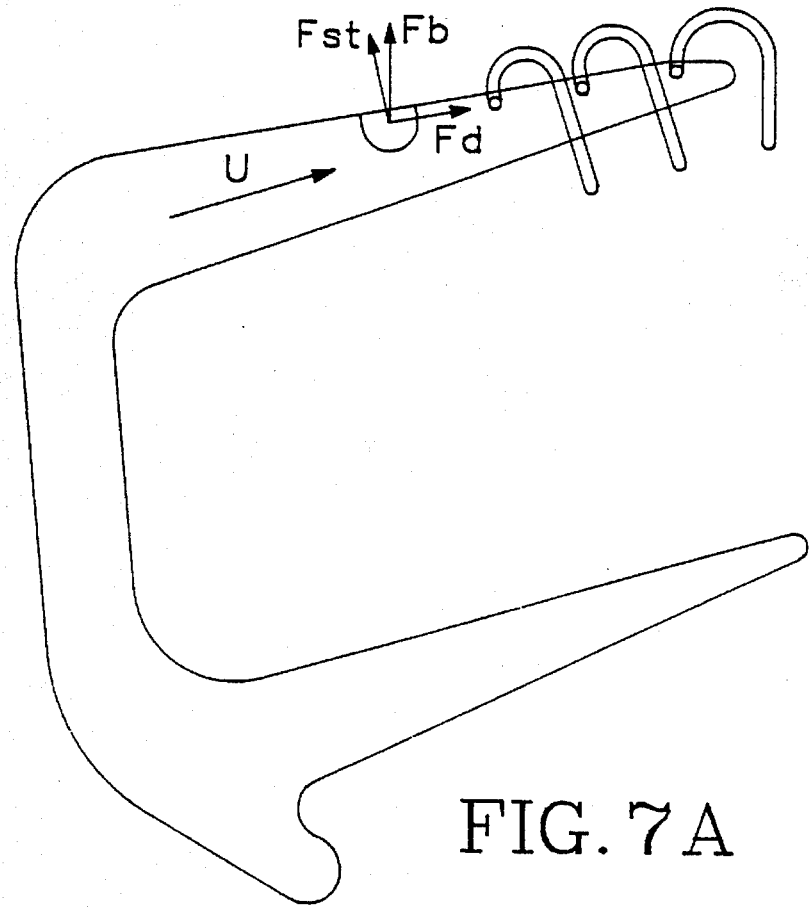
Figure 7B:
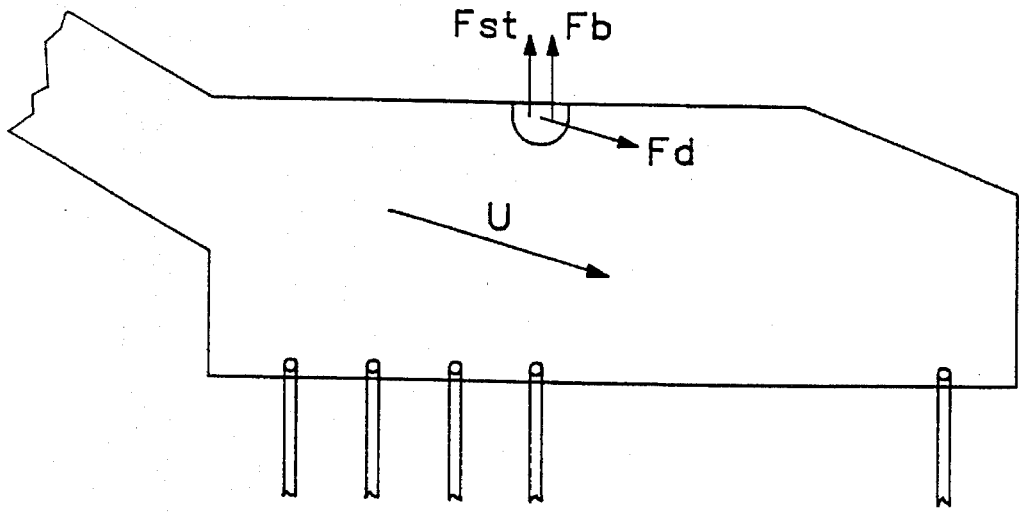

As described with reference to FIGS. 7 and 12, the direction of buoyant and viscous drag forces on bubbles is a factor in manifold design. A common problem in ink jet print heads is the removal of such bubbles from the ink. This is particularly true with high viscosity hot-melt inks that naturally form bubbles during ink freeze/thaw cycles that occur when a printer is turned off and later turned on again. Bubbles can be more easily purged by an ink jet head having a design that maintains elevationally upward ink flow wherever possible. In the improved ink jet head design, all ink flow paths in the manifold flow upward, causing any bubbles present to flow along their intended paths. This natural upward flow of ink, illustrated diagrammatically in FIG. 7A, shows how the buoyancy force vector aids in removing any bubbles from the manifold. The only resistance to this upward flow is the component of the force due to surface tension. The component of the force due to drag also aids in the upward flow of the ink within the manifold. This is in marked contrast to the design shown in FIG. 7B where the bubbles must get to the bottom of the manifold to exit via the jet inlets and the components of the force due to buoyancy and surface tension oppose the drag or purge force component. As described with reference to FIG. 7B, various forces including viscous drag, buoyancy, and surface tension forces act on a bubble. The improved ink jet head design of FIG. 12 further accounts for forces acting on the bubble as a function of bubble diameter. The calculations below yield values for the viscous drag and buoyant forces acting on a bubble as the bubble diameter $D_{bub}$ is stepped from 0.005 cm to 0.15 cm in 0.01 cm steps. Viscous drag and buoyant forces on a bubble are calculated according to the following equations:

$$F_D(D_{bub}) = 3\pi\mu(U_{cross})(D_{bub})$$

$$F_b(D_{bub}) = \frac{\pi\rho g D_{bub}^3}{6}$$

-continued where:

$$g = 981 \text{ cm/sec}^2$$

$$U_{cross} = \frac{M_{purge}}{\rho W L_m} = 1.52 \text{ cm/sec}$$

$$Re_D(D_{bub}) = \frac{\rho(U_{cross})(D_{bub})}{\mu}$$

Figure 18:
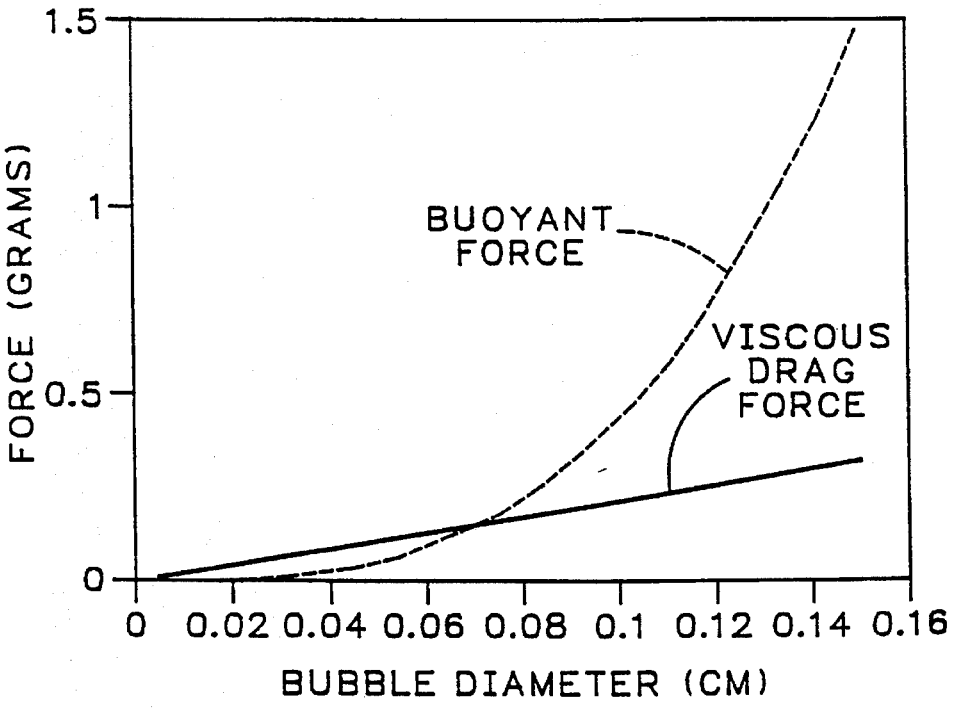
FIG. 18 graphically shows viscous drag and buoyant forces acting on a bubble as a function of bubble diameter.

FIG. 18 shows the results of the above calculations and illustrates the effect on bubble movement of the relative magnitude of the drag force to the bubble force. As bubble diameter increases, the buoyant force increases and dominates for bubbles greater than about 0.07 centimeter in diameter, causing them to float elevationally upward. This makes it difficult to force larger bubbles from the upper edge of a manifold in the design illustrated in FIG. 7B; whereas the buoyant or gravitational force is used to advantage in the improved design shown in FIG. 7A. Therefore, an advantage in the improved design is that some ports 234 (see FIG. 12) are located adjacent to the upper edges of manifolds 222U and 222L, causing buoyant forces to assist bubble flow upward in elevationally upward sloping manifolds 222, through ports 234, and through the upward leading first sections of ink supply channels 214UU and 214L.

Figure 19A:
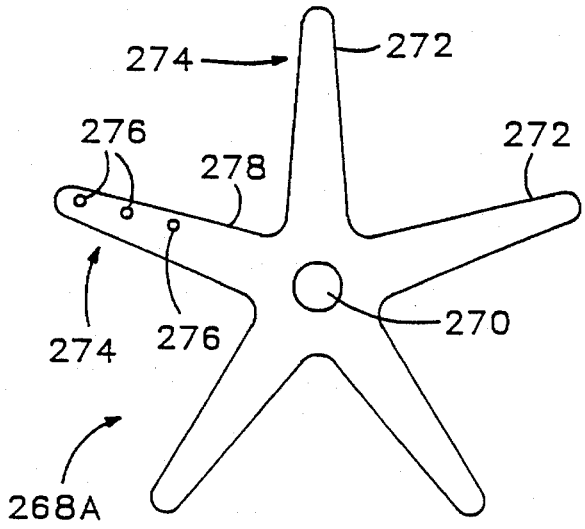
FIGS. 19A, 19B, and 19C are simplified plan views showing three examples of alternative manifolds that are geometrically shaped and have features according to the present invention.
Figure 19B:
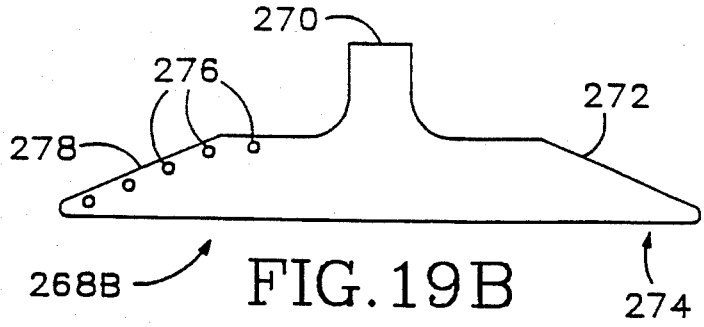
Figure 19C:
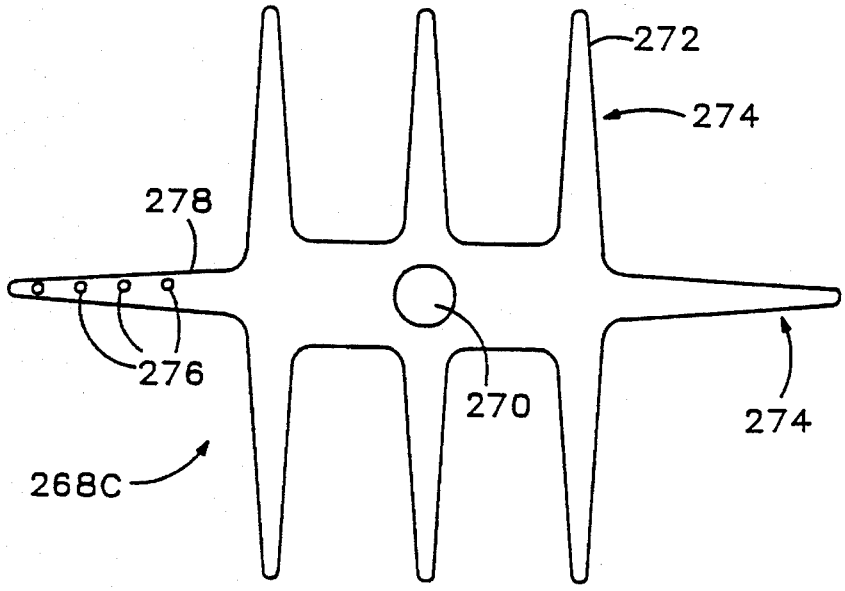

FIGS. 19A, 19B, and 19C show three alternative manifolds 268A, 268B, and 268C (hereafter "manifolds 268") each embodying features and geometric shapes according to the present invention. For example, manifolds 268 have an ink inlet 270, an elevationally upward leading portion 272, and a tapered portion 274. A set of ports 276 are shown adjacent to associated elevationally upward walls 278 of manifolds 268. The geometric shapes of manifolds 268 embody the above-described inventive features to varying degrees but are not intended to limit the scope of the present invention.

It will be obvious to those having skill in the art that many changes may be made to the details of the above-described embodiments of this invention without departing from the underlying principles thereof. Accordingly, it will be appreciated that this invention is also applicable to applications other than those found in drop-on-demand ink jet recording and printing. The scope of the present invention should, therefore, be determined only by the following claims.

We claim:

1. An ink jet printer having a print head with multiple nozzles coupled to an ink source, comprising:

a tapered ink supply manifold having a base end and a tip end, the base end being coupled to the ink source, and in which a ratio of a cross-sectional area of the tip end to a cross-sectional area of the base end of the ink supply manifold is in a range of 0.1 to 0.9;

an ink inlet channel coupling the tapered manifold to the ink source, the ink inlet channel and the tapered manifold each having a length and a cross-sectional area that cause a combination of the ink inlet channel and the tapered manifold to naturally resonate at a frequency above a maximum repetitive operating rate of the nozzles, and an ink purging means for applying a pressure difference across at least a first opening and a second opening on the print head, the pressure difference causing ink to flow through the ink supply manifold, whereby bubbles are effectively purged from the ink supply manifold.

2. The ink jet printer of claim 1 in which the ratio of the cross-sectional area of the tip end to the cross-sectional area of the base end of the ink supply manifold is in a range of about 0.2 to about 0.5.

3. The ink jet printer of claim 1 in which a taper of the ink supply manifold monotonically decreases from the base end to the tip end.

4. The ink jet printer of claim 1 in which a taper of the ink supply manifold is substantially linear.

5. The ink let printer of claim 1 in which an upper edge of the tip end of the ink supply manifold is elevationally higher than an upper edge of the base end of the ink supply manifold.

6. The ink jet printer of claim 1 in which the purging means requires no more than one print head volume of ink to pass through the print head to purge the print head of bubbles.

7. The ink jet printer of claim 1 in which the ink purging means cooperates with the tapered ink supply manifold to cause the ink to flow at a flow rate that produces everywhere in the ink supply manifold to a flow-rate induced drag force on the bubbles that is greater than a viscous force and a buoyant force acting on the bubbles, whereby the bubbles are effectively purged from the ink supply manifold.

8. The ink jet printer of claim 1 in which the first opening and the second opening are each one of a nozzle, a nozzle array, an ink inlet, and a purging outlet port.

9. The ink jet printer of claim 1 in which the pressure difference is generated by at least one of a purging vacuum source and a purging pressure source.

10. The ink jet printer of claim 1 in which the multiple nozzles are coupled to the ink supply manifold by ink supply channels through ports distributed between the base and tip ends of the ink supply manifold.

11. The ink jet printer of claim 10 in which the ports are staggered throughout the ink supply manifold to reduce acoustic cross-talk among the nozzles.

12. The ink jet printer of claim 10 in which at least some of the ports are distributed adjacent to an upper edge of the ink supply manifold.

13. The ink jet printer of claim 10 in which the ink supply channels leading from the ports adjacent to the upper edge of the ink supply have an elevationally upward-leading first section.

14. The ink jet printer of claim 10 in which each of the ink supply channels and associated nozzles are fluidically coupled by an associated ink pressure chamber and ink passage.

15. The ink jet printer of claim 14 in which a tapered transition region fluidically connects each of the ink pressure chambers to the associated ink supply channel or ink passage.

16. A method for purging a bubble from an ink jet head having multiple orifices, comprising the steps of:

providing an ink supply manifold having a volume, a base end, and a tip end, the ink supply manifold being in fluid communication with multiple ink supply channels distributed at locations between the base end and the tip end and having at least a portion of the volume with a linear taper so that a ratio of a cross-sectional area of the tip end to a cross-sectional area of the base end is in a range of about 0.2 to about 0.5;

providing an ink inlet channel coupling the ink supply manifold to an ink source, the ink supply manifold and ink inlet channel each having a length and a cross-sectional area that causes a combination of the ink inlet channel and the ink supply manifold with the taper to resonate at a frequency above a maximum repetitive operating rate of the orifices; and causing ink to flow at a flow rate through an ink inlet adjacent to the base end of the ink supply manifold, whereby the portion of the volume with the linear taper maintains everywhere within the ink supply manifold a flow rate-induced drag force on the bubble sufficient to purge the bubble from the ink supply manifold.

17. The method of claim 16 further including the step of inclining the ink supply manifold elevationally upward so that the tip end is elevationally higher than the base end.

18. The method of claim 16 in which the multiple ink supply channels are distributed at staggered locations between the base and tip ends of the ink supply manifold.

19. The method of claim 16 in which at least some of the ink supply channels are distributed at locations adjacent to an upper edge of the ink supply manifold.

20. The method of claim 19 in which the ink supply channels that are distributed at locations adjacent to an upper edge of the ink supply manifold have elevationally upward, leading first sections.

21. The method of claim 19 in which each of the ink supply channels are fluidically coupled to an associated ink pressure chamber, an ink passage, land a nozzle.

22. The method of claim 21 in which a tapered transition region fluidically connects each ink pressure chamber to an associated ink supply channel or ink passage.

* * * * *